US006860781B2

(12) United States Patent
Hibino et al.

(10) Patent No.: US 6,860,781 B2
(45) Date of Patent: Mar. 1, 2005

(54) DISPLAY PANEL AND MANUFACTURING METHOD FOR THE SAME INCLUDING IMPROVED BONDING AGENT APPLICATION METHOD

(75) Inventors: Junichi Hibino, Neyagawa (JP); Choujurou Yamamitsu, Kawanishi (JP); Hiroyuki Yonehara, Hirakata (JP); Yoshiki Sasaki, Shijyounawate (JP); Katuyoshi Yamashita, Katano (JP); Nobuyuki Kirihara, Hirakata (JP); Kazuo Ootani, Habikino (JP); Yuusuke Takada, Katno (JP); Hideaki Yasui, Hirakata (JP); Ryuichi Murai, Toyonaka (JP); Hidetaka Hiagshino, Kyoto (JP); Nobuaki Nagao, Uji (JP); Masafumi Ookawa, Neyagawa (JP); Hiroyosi Tanaka, Kyoto (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 10/790,399

(22) Filed: Mar. 1, 2004

(65) Prior Publication Data

US 2004/0164679 A1 Aug. 26, 2004

Related U.S. Application Data

(62) Division of application No. 09/786,692, filed on May 14, 2001, now Pat. No. 6,800,010.

(30) Foreign Application Priority Data

| | | |
|---|---|---|
| Aug. 9, 1998 | (JP) | 10-253553 |
| Sep. 16, 1998 | (JP) | 10-261156 |
| Sep. 28, 1998 | (JP) | 10-274072 |
| Oct. 5, 1998 | (JP) | 10-282421 |
| Oct. 8, 1998 | (JP) | 10-286248 |
| Feb. 3, 1999 | (JP) | 11-054781 |
| Mar. 12, 1999 | (JP) | 11-066408 |
| Jun. 2, 1999 | (JP) | 11-155152 |

(51) Int. Cl.[7] ..... H01J 9/00; H01J 9/26

(52) U.S. Cl. ..... 445/25; 445/24; 313/582; 313/587

(58) Field of Search ..... 445/24, 25; 313/582, 313/587, 586, 292

(56) References Cited

U.S. PATENT DOCUMENTS

| | | | |
|---|---|---|---|
| 5,385,499 | A | 1/1995 | Ogawa et al. |
| 5,717,291 | A | 2/1998 | Kim |

(List continued on next page.)

FOREIGN PATENT DOCUMENTS

| | | | |
|---|---|---|---|
| DE | 195 42 426 | A1 | 5/1996 |
| EP | 0 782 167 | A2 | 7/1997 |

(List continued on next page.)

*Primary Examiner*—Joseph Williams
*Assistant Examiner*—German Colón

(57) ABSTRACT

Barrier ribs 18 formed on a back substrate PA2 are brought into contact with a bonding paste layer 40 having an even surface, applying a bonding agent Bd evenly to the tops of the barrier ribs.

Furthermore, a gas discharge panel having a structure in which discharge mainly occurs at locations distanced from parts of the panel connected using the bonding agent Bd is realized.

7 Claims, 35 Drawing Sheets

U.S. PATENT DOCUMENTS

| | | | | |
|---|---|---|---|---|
| 5,742,122 | A | | 4/1998 | Amemiya et al. |
| 5,754,003 | A | | 5/1998 | Murai et al. |
| 5,770,921 | A | | 6/1998 | Aoki et al. |
| 5,909,083 | A | | 6/1999 | Asano et al. |
| 5,992,320 | A | | 11/1999 | Kosaka et al. |
| 6,008,582 | A | * | 12/1999 | Asano et al. ..... 313/582 |
| 6,030,267 | A | | 2/2000 | Browning |
| 6,129,603 | A | * | 10/2000 | Sun et al. ..... 445/25 |
| 6,309,622 | B1 | | 10/2001 | Watkins |
| 6,352,656 | B1 | * | 3/2002 | Kimura et al. ..... 264/2.5 |
| 6,353,287 | B1 | | 3/2002 | Sasaki et al. |
| 6,515,420 | B2 | | 2/2003 | Chen et al. |

FOREIGN PATENT DOCUMENTS

| | | | |
|---|---|---|---|
| EP | 0 789 384 | A1 | 8/1997 |
| EP | 0 814 491 | A2 | 12/1997 |
| EP | 0 836 892 | A2 | 4/1998 |
| EP | 0 837 486 | A2 | 4/1998 |
| EP | 0 782 167 | A3 | 5/1999 |
| EP | 0 945 886 | A1 | 9/1999 |
| EP | 0 814 491 | A3 | 11/1999 |
| FR | 2 738 393 | | 3/1997 |
| JP | 7-37510 | | 2/1995 |
| JP | 8-185802 | | 7/1996 |
| JP | 8-250029 | | 9/1996 |
| JP | 9-102280 | | 4/1997 |
| JP | 10-92326 | | 4/1998 |
| JP | 10-125237 | | 5/1998 |
| WO | 98/27571 | | 6/1998 |

* cited by examiner (1)

(2)

(3)

DISPLAY PANEL AND MANUFACTURING METHOD FOR THE SAME INCLUDING IMPROVED BONDING AGENT APPLICATION METHOD

This is a divisional application of U.S. Ser. No. 09/786,692, now U.S. Pat. No. 6,800,010, filed on May 14, 2001.

TECHNICAL FIELD

The present invention relates to a method for manufacturing a display panel constructed from a pair of connected substrates, and in particular to a method for applying a bonding agent to the substrates.

BACKGROUND ART

An AC-type plasma display panel (hereafter abbreviated to PDP) is a type of gas discharge panel, well-known in the art as one example of a display panel.

A PDP is illustrated in FIG. 42. Here, the PDP is constructed from a front substrate 2000 and a back substrate 2100. The front substrate 2000 is generally produced by forming discharge electrodes 2002 upon a front glass plate 2101. This structure is then covered with a dielectric glass layer 2003 and a protective layer of magnesium oxide (MgO) 2004.

The back substrate 2100 is formed by arranging address electrodes 2102, barrier ribs 2103 and a phosphor layer 2104 on a back glass plate 2101. The front substrate 2000 and the back substrate 2001 are then fixed together, and discharge spaces 2200 are formed by introducing a discharge gas into the spaces demarcated by the barrier ribs 2103. Cells are formed in the discharge spaces 2200 at the points where discharge electrodes 2002 and address electrodes 2102 intersect. FIG. 42 shows only one such cell, but in fact the PDP normally includes a plurality of cells in which the phosphor layer 2104 is composed of alternating red, green and blue phosphors, enabling a color display to be produced. Note that in the drawing, the discharge electrodes 2002 and the address electrodes 2102 are drawn as if arranged in parallel, but in fact they are arranged at right angles.

A discharge gas, such as a mixture of neon and xenon, is normally enclosed into the discharge spaces 2200 at a pressure of around 500 Torr ($6.65\times10^4$ Pa)

In practice, however, such conventional PDPs have not always been able to achieve satisfactory luminance. In order to improve luminance, it is considered necessary to enclose the discharge gas inside the discharge spaces 2200 at an internal pressure exceeding 500 Torr ($6.65\times10^4$ Pa).

However, with the internal pressure in the discharge spaces 2200 is raised to 760 Ton ($1.01\times10^5$ Pa) or 1000 Torr ($1.33\times10^5$ Pa), for example, gaps are generated between the barrier ribs 2103 formed on the back glass plate 2101 and the front substrate 2000, hire the front and back substrates 2000 and 2100 bulge outwards. This means that neighboring discharge spaces 2200 are no longer effectively divided by the barrier ribs 2103, causing the display performance of the PDP to deteriorate.

Even if the internal pressure is set at 760 Torr ($1.01\times10^5$ or less, the barrier ribs 2103 are not connected to the front substrate 2100, so that external vibrations or vibrations caused by driving the PDP itself bring the barrier ribs 2103 and the front substrate 2000 repeatedly into contact, generating noise.

In order to correct these problems, one related technique has proposed that the topmost edge of the barrier ribs 2103 be coated with a bonding agent before fixing the pair of substrates together to form the discharge spaces 2200. A gas discharge panel in which gas has been sealed at a higher pressure is produced, realizing an improvement in luminance. Such a procedure is described in Japanese Patent Application No. 9-49006.

However, when a well-known method such as screen-printing is used to apply the bonding agent to the topmost edge of the barrier ribs 2103, it is difficult to apply the bonding agent equally to the very long and narrow top surfaces of the barrier ribs 2103 without leaving some parts uncovered. In the case of screen-printing, matching an aperture pattern accurately to the shape of the barrier ribs 2103 has proved extremely difficult. As a result, finding a simple method for improving bonding strength, while maintaining display performance and preventing the generation of distortion when the barrier ribs 2103 touch the front substrate 2000 has posed considerable obstacles.

Furthermore, the properties of the dielectric glass layer 2003 covering the electrodes change if exposed to the discharge spaces 2200. As a result, a protective coat of MgO or similar is usually formed to cover the surface of the dielectric glass layer 2003, as described above. Even if a protective layer 2004 is applied in this way, however, the tops of the barrier ribs 2103 are connected after the protective layer 2004 has been applied, and so the surfaces of the bonding agent are not covered by the protective layer 2004. Thus, the properties of the surface of the bonding agent change as a result of exposure to the discharge spaces 2200. Substances produced by this change pollute the discharge spaces 2200 and are the cause of such problems as rises in discharge voltage, falls in discharge efficiency and deterioration in the phosphors.

DISCLOSURE OF THE INVENTION

The present invention has been developed in view of the above problems in the background art. A first object of the invention is to provide a display panel manufacturing method performed by connecting two substrates together as strongly as possible using a bonding agent, and in particular to provide a simple bonding agent application method for arranging the bonding agent evenly on the narrow areas that form the tops of the barrier ribs leaving almost no uncovered areas.

A second object of the present invention is to provide a gas discharge display panel capable of preventing changes in the properties of the bonding agent surface caused by discharge.

To fulfill the above first object, a display panel manufacturing method, comprising an application process for applying a bonding agent to a plurality of barrier ribs formed on at least one of a pair of substrates, and a connection process for arranging the pair of substrates together via the bonding agent that has been applied to the barrier ribs is provided. The application process includes a bonding agent layer forming step for forming a layer of a past-like bonding agent having an even surface over a substrate having an even surface: and a connecting step for simultaneously bringing a top of each baffler rib down into contact with the bonding agent layer, while regulating a distance between the upper surface of the bonding agent layer and the barrier ribs.

A display panel manufacturing method may further include an application process for applying a bonding agent to a plurality of barrier ribs formed on at least one of a pair of substrates and a connection process for arranging the pair of substrates in opposition and connecting the pair of substrates together via the bonding agent that has been applied to the barrier ribs. The application process includes a bonding agent layer forming step for forming a layer of a paste-like bonding agent having an even surface so as to embed a position regulating member that regulates positions of the barrier ribs within the layer, the position regulating member being arranged on a substrate having an even surface: and a connecting step for bringing a top of each barrier rib down into contact with the Position regulating member to apply the bonding agent simultaneously to the tops of all of the barrier ribs while regulating a distance between the upper surface of the bonding agent layer and the barrier ribs.

Furthermore, a display panel manufacturing method may include an application process for applying a bonding agent to a plurality of barrier ribs formed on at least one of a pair of substrates in opposition and connecting the pair of substrates together via the bonding agent that has been applied to the barrier ribs, The application process includes a bonding agent layer forming step for forming a layer of a paste-like's bonding agent having a curved surface so as to embed a position regulating member that regulates positions of the barrier ribs within the layer. the position regulating member being arranged on a substrate having a curved surface: and a connecting step for bringing a part of each barrier rib top down into contact with the position regulating member, and then to move the position regulating member alone a length of the barrier ribs to apply the bonding agent to the tops of all of the barrier ribs while regulating a distance between the upper surface of the bonding agent layer and the barrier ribs.

In this way, the invention aligns barrier rib tops and the bonding agent arranged on the barrier rib tops using surface tension created on the surface of the barrier ribs by bringing the barrier rib tops and the surface of a bonding paste layer into the appropriate degree of contact. This method is used rather than a screen plate with an aperture pattern like that used in screen-printing. As a result, the bonding agent can be applied evenly along the narrow barrier rib tops using a simple technique, even if the barrier rib tops are not strictly linear, and form wavy lines.

This means that, if a screen-printing method is used when the barrier ribs are arranged in a stripe formation, aligning the barrier ribs with the screen plate is difficult due to slight variations in barrier rib pitch. As a result, when such a conventional technique is used, the barrier rib tops and the bonding agent are not correctly aligned, and the bonding agent cannot be evenly applied to the barrier rib tops. Furthermore, if the barrier ribs are formed in wavy lines, aligning the barrier ribs accurately with the screen plate is more difficult, and applying the bonding agent evenly to the barrier rib tops becomes even more problematic. In contrast, using the present invention enables the bonding agent to be applied evenly to the barrier rib tops without the variations in barrier rib pitch and barrier ribs formed in wavy lines having any impact.

Here, the bonding agent can be applied more liberally to the barrier rib tops for connecting with the front substrate than was possible when it could not be evenly applied, producing a display panel with greater bonding strength.

By attaching the bonding agent to the barrier ribs using surface tension as explained above, the bonding agent can be applied to the barrier rib tops in an ideal shape. This reduces the degree of bond seepage into the cell area, so that the fall in the amount of luminance produced from the front glass plate is limited.

The following is an explanation of the ideal shape in which the bonding agent should be applied to the barrier rib tops. FIG. 41 shows a cross-section of this shape.

As shown in FIG. 41A, the ideal shape for applying the bonding agent 2300 is formed so that the bonding agent 2300 is more thickly applied near the center of the barrier rib top as seen in cross-section, and becomes thinner towards the edges. When the barrier ribs 2103 are connected to the front panel, the bonding agent 2300 oozes out from either side of each barrier rib 2103, as shown by the protruding parts 2301 in the drawing. Such protruding parts 2301 reduce the light-emitting area as seen from the front glass plate by a corresponding amount, causing luminance to deteriorate. Accordingly, the protruding parts 2301 need to be made as small as possible to limit deterioration in luminance. Thus it is preferable for the shape of the bonding agent 2300 before the barrier ribs are connected to be formed so that a thinner coating runs along both sides of the top of each barrier rib 2103.

Here, the relative positions of the barrier ribs the bonding agent can be altered while keeping the barrier ribs in the contact with the bonding agent layer. Thisenables the bonding agent to be applied more evenly to the ribs tops.

The bonding agent applying process should preferably be repeated a plurality of times.

The position regulating member may be made from wire rods, which are either interwoven or lined up precisely. The position regulating member may also be composed of indentations and protrusions formed on the surface of a flat substrate, or may be a plurality of half-cylinders, the barrier rib tops being brought into contact with the curved surface of the half-cylinders.

If the bonding agent is applied after implementation of a process for leveling the barrier ribs across the entire surface of the substrate so that all the barrier rib tops are at approximately the same height, variations in the amount of bonding agent applied, caused by variations in the height of different barrier ribs or along the length of one barrier rib, are eliminated. This allows the bonding agent to be evenly applied to the barrier rib tops without any irregularities.

In order to achieve the first object, a display panel manufacturing method, for connecting a pair of substrates arranged in opposition via a plurality of barrier ribs formed in a specific pattern on at least one of the substrates and a bonding agent arranged on the barrier ribs is provided. The display panel manufacturing method includes a barrier rib pattern forming process and a bonding agent pattern forming process. These processes include a first step for laminating the bonding agent and a material for forming the barrier ribs by forming layers of certain thicknesses; a second step for simultaneously removing corresponding parts of the laminated barrier rib material and bonding agent to form the specific pattern; and a third step for transferring the pattern formed in the barrier rib forming material and bonding agent to the substrate on which the barrier ribs are to be formed.

Here, the barrier rib tops and the bonding agent arranged on the barrier rib tops are aligned by removing corresponding parts of the barrier rib and bonding agent layers at the same time. The pattern for the barrier ribs and the bonding agent can thus be formed simultaneously. This method is used rather than a screen plate with an aperture pattern like that used in screen-printing. As a result, the bonding agent can be applied evenly along the narrow barrier rib tops using a simple technique, even if the barrier rib tops are not strictly linear, and form wavy lines. This produces a display panel with greater bonding strength.

Also in order to achieve the above first object, a display panel manufacturing method, for connecting a pair of substrates arranged in opposition, via a bonding agent, which has been applied to a plurality of barrier ribs formed in a specific pattern on at least one of the substrates is provided. The display panel manufacturing method includes a barrier rib pattern forming process including a first step for laminating the barrier rib forming material and the bonding' agent by forming layers of certain thicknesses: a second step for simultaneously pressing down the laminated barrier rib forming material and bonding agent using a same pattern-forming member to form the specific pattern: and a third step for transferring a molded pattern formed in the barrier rib forming material and bonding agent to the substrate on which the barrier ribs are to be formed.

Here, the barrier rib tops and the bonding agent arranged on the barrier tops are aligned by forming the pattern for the barrier ribs and the bonding agent simultaneously. This method is used aperture pattern like that used in screen-printing. As a result, the bonding agent can be applied evenly along the narrow barrier rib tops using a simple technique, even if the barrier rib tops are not strictly linear, and form wavy lines. This produces a display panel with greater bonding strength.

Here, at least one indentation and protrusion is formed on the parts of the pattern-forming member that correspond to top surfaces of the barrier ribs on which the bonding agent is applied.

Here, the alignment of the barrier ribs and the bonding agent is determined by indentations and protrusions, allowing the bonding agent to be arranged more accurately on the barrier rib tops. This produces a display panel with greater bonding strength.

Also, in order to achieve the above first object, a display panel manufacturing method, for connecting a pair of substrates arranged in opposition via a bonding agent arranged on a plurality of barrier ribs formed in a specific pattern on at least one of the substrates is provided. The display panel manufacturing method includes an indentation forming process for forming at least one indentation in a center of each barrier rib top, when viewed widthwise; and a bonding agent arranging process for arranging the bonding agent in the indentations.

The barrier rib tops and the bonding agent arranged on the barrier rib tops are here aligned by indentations formed in advance in the central area of the barrier rib tops. This method is used rather than a screen plate with an aperture pattern like that used in screen-printing. As a result, the bonding agent can be applied evenly along the narrow barrier rib tops using a simple technique, even if the barrier rib tops are not strictly linear, and form wavy lines.

When the bonding agent is arranged on barrier rib tops without indentations, the bonding agent tends to seep off the barrier rib tops. This is another reason why the bonding agent cannot be arranged evenly on the barrier rib tops. Since the bonding agent in the present invention is arranged in the indentations formed in the barrier rib tops, this kind of run-off is prevented, enabling the bonding agent to be applied evenly to the barrier rib tops. As a result, a display panel having greater bonding strength can be obtained.

Additionally, arranging the bonding agent in the indentations prevents the bonding agent from trickling down from the barrier rib tops into the front glass plate side of the panel when firing is performed.

The barrier rib pattern is formed by pressing a pattern-forming member onto the barrier rib forming material, the barrier rib forming material being arranged in a layer of a specific thickness, and the indentation forming process is performed simultaneously with the barrier rib pattern formation when the pattern-forming member is pressed onto the barrier rib forming material.

Here, the bonding agent may be arranged in the indentations using a screen-printing method, or by a method in which the bonding agent is injected into the indentations via a nozzle. Of the several possible methods, the nozzle-injection method is preferred since this method applies the bonding agent to the indentations most accurately.

In order to achieve the first object, a display panel manufacturing method, for connecting a pair of substrates arranged in opposition via a bonding agent arranged on a plurality of barrier ribs formed in a specific pattern on at least one of the substrates is provided. A process for arranging the bonding agent on the barrier ribs includes an attaching process for attaching a bonding agent positioning member to the barrier ribs; a first removing process for removing parts of the bonding agent positioning member attached to the barrier rib tops at positions corresponding to the specific pattern, to form a groove along each barrier rib top: a bonding agent filling process for filling the grooves with the bonding agent, while maintaining the relative positions of the grooves and the barrier rib 'tops: and a second removing process for removing the remaining bonding agent positioning member.

Here the barrier rib tops and the bonding agent arranged on the barrier rib tops are aligned based on a pattern formed so that it conforms to the barrier rib pattern. This method is used rather than a screen plate with an aperture pattern like that used in conventional screen-printing techniques. As a result, the bonding agent can be applied evenly along the narrow barrier rib tops using a simple technique, even if the barrier rib tops are not strictly linear, and form wavy lines. This enables a display panel with greater bonding strength to be obtained. Further more, the bonding agent is prevented from flowing off the barrier rib tops by the bonding agent positioning member, until the bonding agent positioning member is removed.

The adhesion process is performed by applying the bonding agent positioning member to the barrier ribs after a connecting layer is formed on either the barrier ribs or the bonding agent positioning member.

The first removing process removes parts of the bonding agent positioning member attached to the barrier rib tops by irradiating the surface of the bonding agent positioning member with a laser.

Here, it is preferable that a material used for the barrier rib tops absorbs laser light more easily than a material used for other parts of the barrier ribs.

The first removing process may form holes in the first member adhering to the barrier rib tops using a grinding method.

Here, if the central area of each barrier rib top is removed in the first removing process, the amount of bonding agent that seeps into the cell area after the panel has been sealed is further reduced.

Here, in the bond agent filling process, the bond agent may be applied using a screen-printing method or a nozzle-injection method.

The second removing process removes the remainder of the first member using peeling, melting and sublimation.

The above first object may also be achieved by a display panel manufacturing method, for connecting a pair of substrates arranged in opposition via a bonding agent applied to a plurality of barrier ribs formed on at least one of the substrates. A process for arranging the bonding agent on the barrier ribs includes an arranging process for bringing a an already formed bond sheet into contact with tops of the barrier ribs; a transfer process for transferring the bonding agent to the parts of the barrier rib in contact with the bond sheet by pressing the bond sheet onto the barrier rib tops and a removing process for separating the bond sheet from the barrier ribs.

Here, the bonding agent in the present invention is arranged on the barrier rib tops with the bonding agent and the barrier rib tops in an accurately aligned state by bringing a bond sheet and the barrier rib tops into contact and transferring the bonding agent selectively to those parts of the barrier rib tops touching the bond sheet. This method is used rather than a screen plate with an aperture pattern like that used in screen-printing. As a result, the bonding agent can be applied evenly along the narrow barrier rib tops using a simple technique, even if the barrier rib tops are not strictly linear, and form wavy lines. This enables a display panel with greater bonding strength to be obtained.

The transfer process should preferably heat the parts of the bond sheet in contact with the barrier rib tops.

This gives the bonding agent greater adhesiveness, enabling it to be transferred to the barrier rib tops with more reliability.

The above first object may also be achieved by a display panel manufacturing method, for connecting a pair of substrates arranged in opposition via a plurality of barrier ribs formed on at least one of the substrates, and a bonding agent applied to the barrier ribs. The display panel manufacturing method includes an applying process for applying the bonding agent to an area on each barrier rib that is at least as large as a top of each barrier rib; a hardening process for selectively hardening parts of the attached bonding agent positioned in a central area of the barrier rib tops, when viewed widthwise and a removing process for removing the parts of the bonding agent that-have not been hardened.

Here, the application area for the bonding agent is not established from the outset as in screen-printing. Instead, the bonding agent is arranged on the barrier rib tops, covering an area than is wider than the barrier rib tops. Central parts of the arranged bonding agent are then hardened and the parts that still remain soft are selectively removed, leaving the bonding agent arranged appropriately along the barrier rib tops. As a result, the bonding agent can be applied evenly along the narrow barrier rib tops using a simple technique, enabling a display panel with greater bonding strength to be obtained. If the accuracy with which parts of the bonding agent are hardened can be improved, the bonding agent can be applied evenly along the, narrow barrier rib tops using a simple technique, even if the barrier rib tops are not strictly linear, and form wavy lines. This enables a display panel with even greater bonding strength to be obtained. arranged appropriately along the barrier rib tops. As a result, the bonding agent can be applied evenly along the narrow barrier rib tops using a simple technique, enabling a display panel with greater bonding strength to be obtained. If the accuracy with which parts of the bonding agent are hardened can be improved, the bonding agent can be applied evenly along the narrow barrier rib tops using a simple technique, even if the barrier rib tops are not strictly linear, and form wavy lines. This enables a display panel with even greater bonding strength to be obtained.

In the applying process, a compound of bonding agent and photo-hardening resin is applied to the barrier rib tops; and in the hardening process, central parts of the applied compound are exposed to light, causing the exposed parts of the compound to harden.

A resin that hardens upon exposure to ultra-violet light is used as the photo-hardening resin, and the light used in the hardening process may be ultra-violet light.

In the hardening process, after ultra-violet irradiation has taken place, hardened parts of the bonding agent are heated.

This enables the hardened bonding agent to be more firmly hardened.

The bonding agent is arranged on the barrier ribs using a compound including a substance which is more difficult to melt than the bonding agent.

The substance supports the load of the front substrate, preventing bonding agent melted when the substrates are sealed from being pressed down by the weight of the front substrate and seeping into the cell area. This stops the panel from being fired with bonding agent seepage inside the cell area.

Next, to achieve the above second object, the present invention also includes a gas discharge panel, including a first substrate, on which a plurality of pairs of electrodes extending in :a first direction, and a dielectric layer covering the electrodes have been formed, and a second substrate, on which a plurality of barrier ribs, extending in a second direction differing from the first direction, are formed in opposition to the dielectric layer and the electrode pairs so that the barrier ribs are separated from the dielectric layer and the electrode pairs. Here the dielectric layer and the barrier ribs are at least partially connected via a bonding agent. The panel is structured such that discharge mainly occurs in parts of the panel separated from the positions where the barrier ribs and the dielectric layer are connected.

This means that discharge does not occur equally throughout each cell, but is more likely to occur in the parts of a cell distanced from the locations where the barrier ribs are connected than in those parts near to the connected areas. Accordingly, the bonding agent applied to the barrier rib tops is less likely to be exposed to discharge, preventing pigments, residual carbon, and the like from contaminating the discharge gas in the discharge spaces. As a result, increases in discharge voltage, deterioration of the phosphor layer, and reduction in luminance are less likely, and initial operating performance can be sustained over the long term.

The panel structure described above may be formed in a variety of ways, as explained below.

One option is a panel structure in which the gaps between pairs of facing electrodes have both wide and narrow sections, and the narrow sections are formed in the spaces between the parts of the dielectric layer to which the barrier ribs are connected. Another option is a panel structure in which a protective layer covers the surface of the dielectric layer, aside from the parts of the dielectric layer where the barrier ribs are connected. A further option is a panel structure in which the parts of the dielectric layer where the barrier ribs are connected are thicker than the other parts of the dielectric layer. Yet another option is a panel structure in which a protective layer is formed on the surface of the dielectric layer, and the barrier ribs connected to the protective layer, so that the parts of the protective layer where the barrier ribs are connected have less surface roughness than the other parts of the protective layer. Yet another option is a panel structure in which a protective layer is formed on the surface of the dielectric layer, and the barrier ribs connected to the protective layer, so that the parts of the protective layer where the barrier ribs are connected are thicker than the other parts of the protective layer. Yet a further option is a panel structure in which parts of the barrier ribs which do not correspond to cells are attached to the front substrate. Another option is a panel structure in which the barrier ribs are partially connected to the first substrate with a bonding agent, which is applied to the barrier rib tops so that the area covered is narrower than each barrier rib top.

The term 'barrier rib tops' in the last panel structure described above refers to a flat area on the top of each barrier rib, if the barrier ribs have a level upper surface. Alternately, if the tops of the barrier ribs have a curved surface, the term refers to an area determined by a value that is approximately double the size of the radius of the curved surface.

Gas should preferably be enclosed in the space between the 15 first and second substrates of the gas discharge panel at a pressure of not less than 760 Torr (1 .01×$10^5$ Pa).

BEST MODE FOR CARRYING OUT THE INVENTION

First Embodiment

Figure 1:
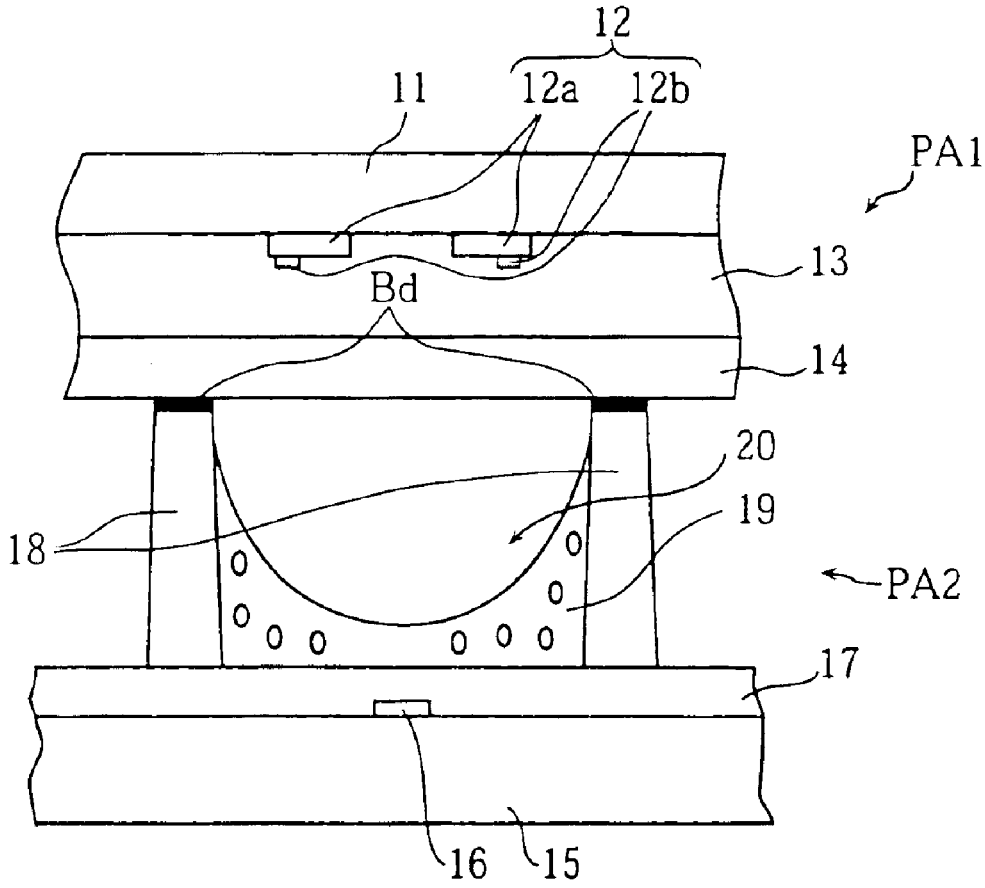
FIG. 1 is a cross-sectional diagram showing an outline of an AC surface discharge PDP relating to the first embodiment.

An Overview of the General Structure of the PDP and the PDP Manufacturing Method FIG. 1 is a cross-sectional drawing of an AC surface discharge PDP relating to the first embodiment of the invention. Only one cell is shown in the drawing, but in fact a PDP in which a plurality of cells emitting red, green and blue light are arranged alternatively is constructed. Note that in the drawing discharge electrodes 12 and address electrodes 16 are drawn as if arranged in parallel, but in fact they are arranged at right angles.

The PDP is an AC surface discharge panel inside which discharge is caused by applying a pulse voltage to the electrodes. Discharge is accompanied by the generation of visible light of various colors inside the PDP near to a back substrate PA2 and this light passes through the main surface of a front substrate PA1.

The front substrate PA1 is formed in the following way. Discharge electrodes 12 are lined up in stripes on a front glass plate 11 and this structure is covered with a dielectric glass layer 13, which is further covered with a protective layer 14. The discharge electrodes 12 are constructed by forming transparent electrodes 12*a* on the surface of the front glass plate 11, and then forming metal electrodes 12*b* on top of the transparent electrodes 12*a*.

The back substrate PA2 is formed in the following way. Address electrodes 16 are lined up in stripes on a back glass plate 15, and this structure is covered with a visible light reflecting layer 17, which protects the address electrodes 16 and reflects visible light towards the front panel. Barrier ribs 18 are erected on the visible light protecting layer 17 in a direction parallel to the address electrodes 16, so that each address electrode 16 seems to be sandwiched by two barrier ribs 18. A phosphor layer 19 is applied to the spaces formed between the barrier ribs 18.

Manufacture of the Front Substrate PA1

The front substrate PA1 is manufactured by forming the discharge electrodes 12 on the surface of the glass plate 11, covering the discharge electrodes 12 with a dielectric glass layer 13 and applying a protective layer 14 to the surface of the dielectric glass layer 13.

The discharge electrodes 12 are formed in the following way. First, the transparent electrodes 12*a*, made of a transparent, electro-conductive metal oxide such as indium tin oxide (ITO), are formed using a method such as sputtering. The pattern for the metal electrodes 12*b* is produced on top of this by applying silver paste using a printing method such as screen-printing or ink-jet printing, and then firing the result. The metal electrodes 12*b* may alternatively be constructed from three layers, made respectively of chromium, copper and chromium (Cr—Cu—Cr).

The dielectric glass layer 13 is a composite formed by mixing a plurality of inorganic materials with an organic binder in which 10% of ethyl cellulose is dissolved in −α terpineol. The inorganic materials may be a composite of, for example, 70% lead oxide (PbO), 15% diboron trioxide ($B_2O_3$), 10% silicon dioxide ($SiO_2$) and 5% aluminum oxide. This composite is applied by a printing method such as screen-printing, and then fired at a temperature of around 500° C. for about twenty minutes to produce a layer 30 $\mu$m thick (the figures here are all example values, and may be varied).

The protective layer 14 is composed of magnesium oxide (MgO) and applied using a method such as electron beam vapor deposition.

Manufacture of the Back Substrate PA2

The back substrate PA2 is constructed in the following way. Address electrodes 16 are formed on a back glass plate 15, which is then covered by a visible light reflecting layer 17. Barrier ribs 18 are formed on the surface of the visible light reflecting layer 17 and a phosphor layer 19 is formed between the barrier ribs 18.

The address electrodes 16 are produced in the same way as metal electrodes 12*b*, by applying silver paste to the surface of the back glass plate 15 using a printing method such as screen-printing or ink-jet printing.

The visible light reflecting layer 17 is formed by printing a suitable material on top of the address electrodes 16 using a printing method such as screen-printing, and then firing it. A thin layer of the same kind of glass composite as was used for the dielectric glass layer 13, further including particles of titanium oxide ($TiO_2$), is suitable for this purpose.

Figure 41A:
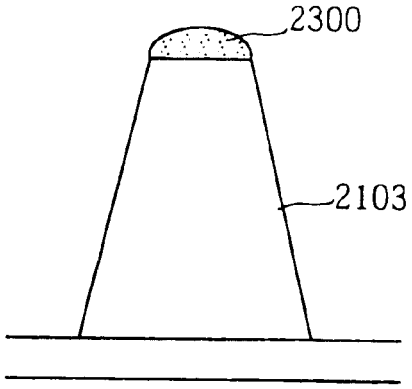
FIGS. 41A and 41B illustrates the formation of the bonding agent applied to the barrier ribs.
Figure 41B:
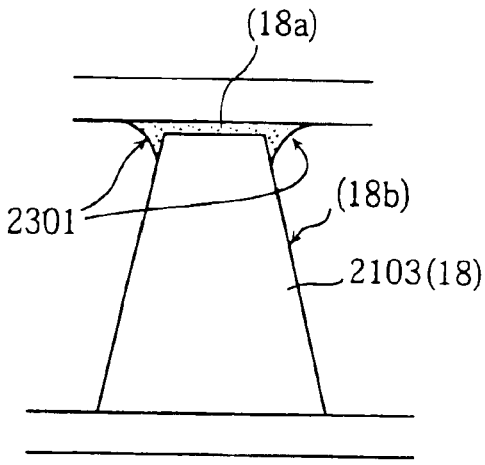
Figure 42:
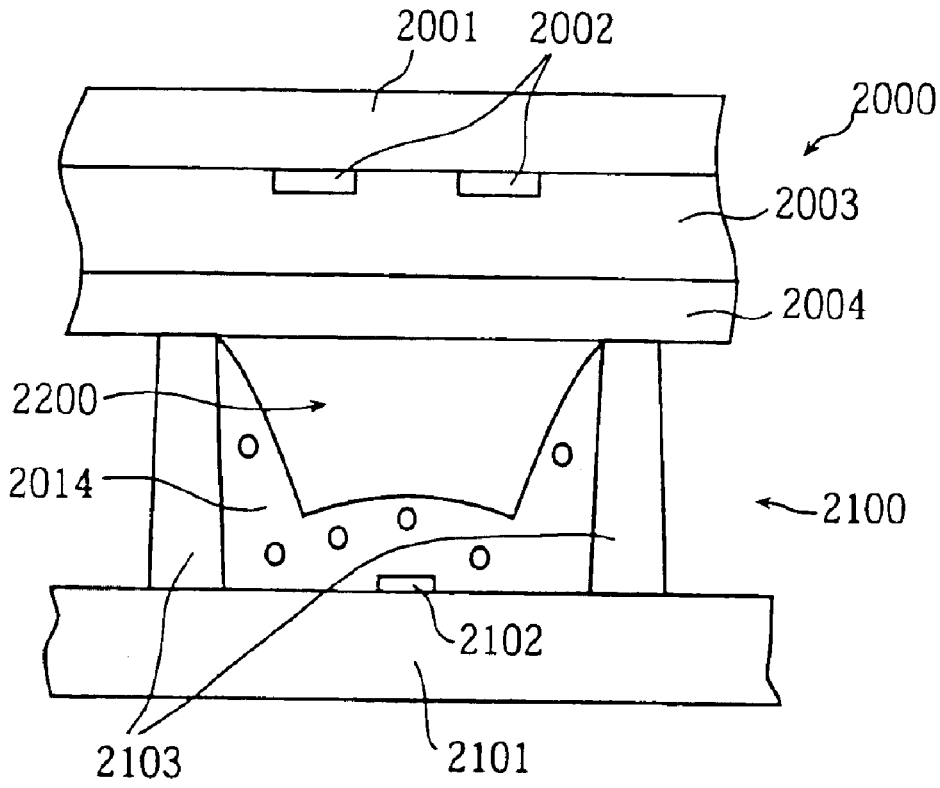
FIG. 42 shows a structure for a PDP relating to the background art example.

The barrier ribs 18 are produced by applying a material using a method such as screen-printing, lift-off or sand-blasting, firing the result, and then processing the tops of the barrier ribs 18. The barrier ribs 18 thus formed are shaped as shown in FIG. 41. From the drawing, it can be seen that the barrier ribs 18 are trapezoid in cross-section and have exposed surfaces. The trapezoid is composed of an upper surface 18*a*, which is roughly parallel to the plates, and a side part 18*b*, which will later be in contact with the phosphor layer.

The phosphor layer 19 may be formed using any well-known method, such as screen-printing, or by a nozzle-spraying method described below.

Figure 2:
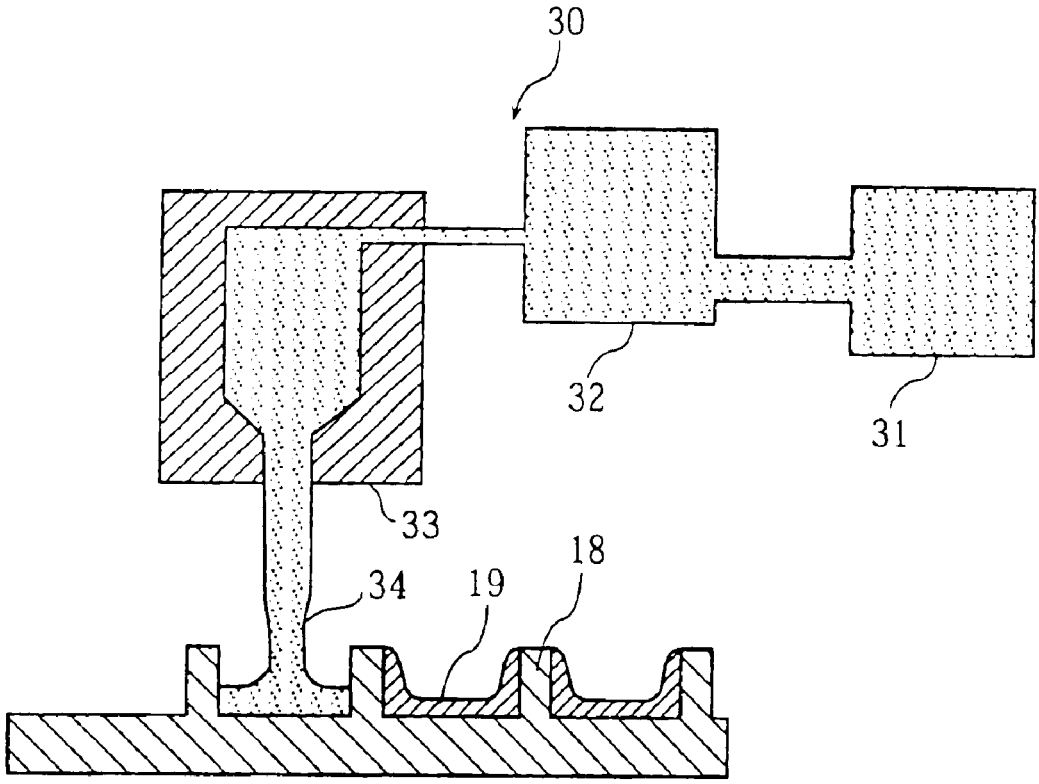
FIG. 2 shows an outline of the structure of an ink applying device used when forming the phosphor layer.

FIG. 2 is an outline drawing of the construction of an ink applying device 30, used in producing the phosphor layer 19. First phosphor powder, terpineol and ethyl cellulose are introduced into a server 31 to form phosphor ink 34. The phosphor ink 34 is sprayed from a nozzle 33 of a spray device, under pressure from a pump 32. Phosphor lines in each of the three colors are formed by spraying the phosphor ink 34 in stripes into the spaces between the barrier ribs 18, while simultaneously moving the substrate in a straight line. The phosphor layer 19 is finished by firing at a certain temperature of around 500° C.

Phosphors commonly used in the art, such as those described below, may be used to produce the phosphor lines.

| | |
|---|---|
| Red phosphor: | $Y_2O_3:Eu^{3+}$ |
| Green phosphor: | $Zn_2SiO_4:Mn$ |
| Blue phosphor: | $BaMgAl_{10}O_{17}:Eu^{2+}$ |

Finishing the PDP by Fixing the Substrates Together

Next, front substrate PA1 and the back substrate PA2 are sealed together with the discharge electrodes 12 at right angles to the address electrodes 16. This-is achieved by pressing the tops of the barrier ribs 18 coated with a bonding agent onto the surface of the protective layer 14 on the front substrate PA1 and firing the PDP. The PDP is completed by enclosing a discharge gas (a mixture of inert gases with, for example, a He—Xe or Ne—Xe base) inside the discharge spaces 20 defined by the barrier ribs 18.

In the present embodiment, the pressure of the enclosed inert gas is set at a high level of at least 760 Torr ($1.01\times10^5$ Pa), and at least as great as atmospheric pressure.

The reason for using this kind of high pressure is that the shape of the discharge is likely to be altered, enabling a linear glow discharge or a two-phase glow discharge to be more easily produced, rather than simply producing a conventional one-phase glow discharge. This increases electron density in the positive column of the discharge, allowing energy to be supplied in a concentrated fashion. Resulting increases in ultra-violet light emissions and the like improve luminous efficiency and allow high luminance levels to be obtained. A more detailed description of this process can be found in Japanese Patent Application No. 10-229640.

The following is a description of the main point of this invention: a method for fixing the front substrate PA1 and the back substrate PA2 together, and in particular a method for applying a bonding agent for fixing the barrier ribs 18 and the protective layer 14 to the barrier ribs 18 in order.

The Panel Fixing Method, Concentrating on the Method for Applying a Bonding Agent Bd to the Barrier Ribs 18

As explained above, inert gas is introduced into the discharge spaces 20 of the PDP in the present embodiment at a pressure higher than atmospheric pressure in order to improve luminous efficiency.

Accordingly, the front substrate PA1 and the back substrate PA2 need to be fixed firmly together so as to withstand this pressure. The front substrate PA1 and the back substrate PA2 are connected, with the barrier ribs 18 used as spacers. When a conventional screen-printing method is used to apply a bonding agent to the barrier ribs 18, however, it is difficult to coat the entire upper surfaces of the barrier ribs 18 evenly. The shape of the coating differed from the ideal shape described above, so that after the substrates were connected, the bonding agent spread out over a wide area stretching as far as the cell area, thereby reducing the amount of light-producing surface area in the cells. This meant that the effects gained from enclosing the gas at a higher pressure were not as great as expected. The application method in the present embodiment, however, can apply the bonding agent Bd to the barrier ribs 18 evenly, achieving a shape close to the ideal shape, as described below.

Figure 3:
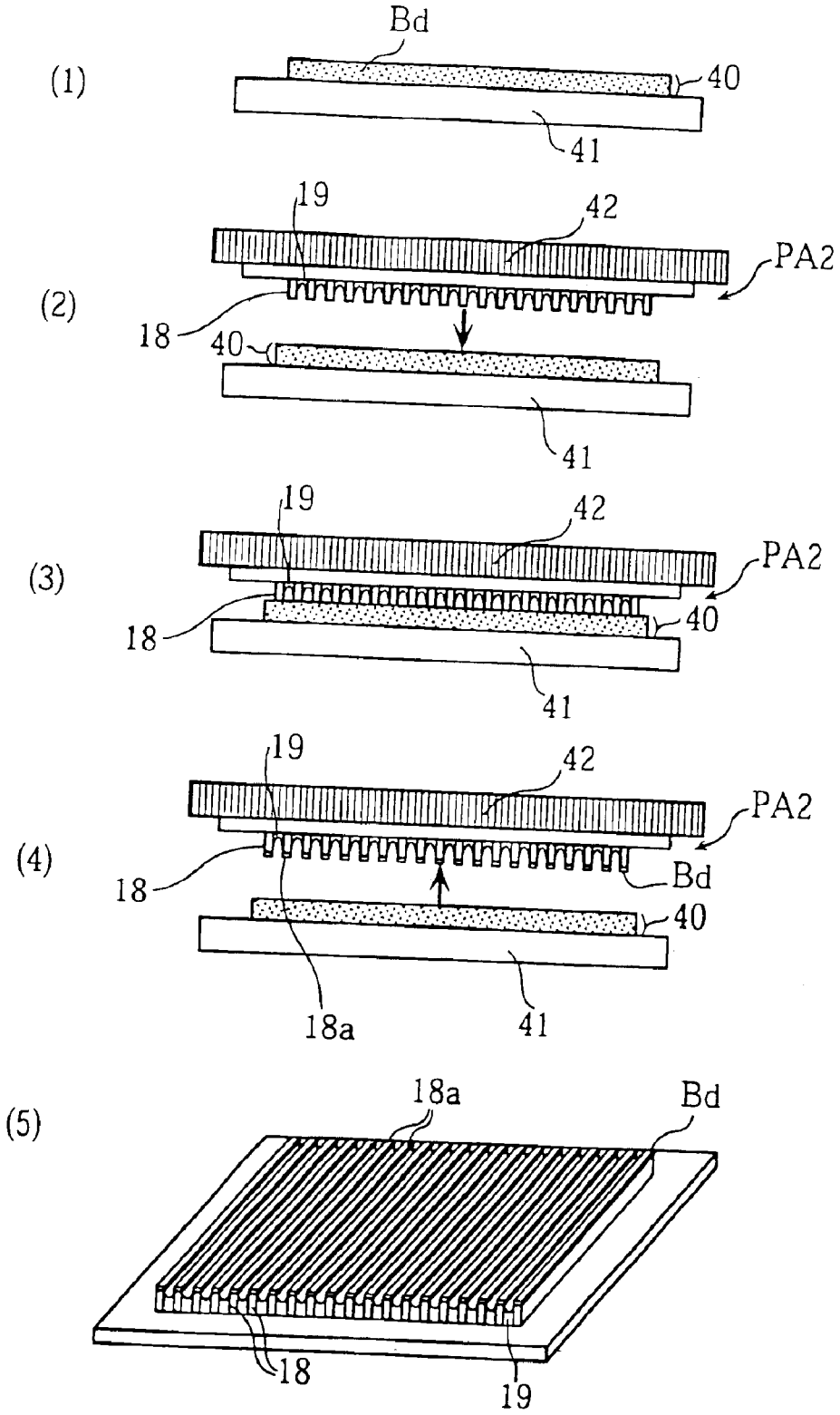
FIG. 3 shows a method for arranging the bonding agent on the tops of the barrier ribs.

FIG. 3 illustrates a method for forming the bonding agent Bd on the tops of the barrier ribs. The application process takes place in the stages (1) to (4) shown in FIG. 3.

In stage (1), a paste layer 40 formed from the bonding agent Bd is applied to the surface of a flat plate 41, made of glass or the like. Both the surface of the flat plate 41 and the paste layer 40 are even. The paste layer 40 may be applied by spreading the bonding agent Bd across the surface of the flat plate 41, using a wire bar or similar as a squeegee, or by using a dye coating method. The paste used as the bonding agent Bd is a composite formed by tempering a glass frit with an acrylic resin and a solvent such as terpineol. The frit is glass with a low softening point, such as around 500° C., mixed with a filler made of ceramic particles or similar. The filler serves as a thermal expansion conditioner to cope with the volume changes experienced by the bonding agent Bd during firing. It is the glass with a low melting point that mainly functions as the bonding agent when the barrier ribs 18 and the front substrate PA1 are fixed together. Glass with a low melting point that includes a black pigment may also be used for this purpose. If such a black pigment is used, a visual effect, in which the variously colored light emitted by the screen appears more brilliant, is obtained. The paste used for the bonding agent Bd should preferably have a high viscosity. If a paste with a low viscosity is used, it runs down the sides of the barrier ribs 18 when applied, and is thus likely to seep into the already formed phosphor layer. Thus, a paste with a viscosity of between 50 and 300 Pa·s s should preferably be used.

Next, in stage (2), the outer surface of the back panel PA2 is gripped by base 42 so that-the opposing surfaces of the back panel PA2 on which the barrier ribs 18 and the phosphor layer have been formed, and the flat plate 41 are almost parallel. The base 42 includes a mechanism for sliding the flat plate 41 up and down while keeping it in parallel with the base 42. The back panel PA2 is gripped by the base 42 using sufficient suction to eliminate the curvature of the back glass plate 15. Thus, the base 42 enables the flat plate 41 and the back substrate PA2 to be kept roughly in parallel.

In stage (3), the base 42 is slowly moved a specified amount until the tops 18*a* of the barrier ribs 18 and the paste layer 40 substantially coincide, bringing the barrier ribs 18 into contact with the paste layer 40.

Next, in stage (4), the base 42 is slowly moved in the opposite direction, separating the barrier ribs 18 from the paste layer 40.

By following the processing sequence described above, the bonding agent Bd is applied evenly to virtually the entire surface of the tops 18*a* of the barrier ribs 18, which are narrow areas running the length of each barrier rib 18. Moreover, the bonding agent Bd is applied so that a shape close to the ideal one described above is obtained.

The reason the barrier ribs 18 are moved slowly into contact with the paste layer 40 is to ensure that the bonding agent Bd is applied evenly. If the barrier ribs 18 enter the paste layer 40 suddenly, irregularities can be caused by inertia. In addition, if the barrier ribs 18 are extracted too suddenly from the paste layer 40, the bonding agent Bd may be shaken loose by mechanical vibrations caused by the motor moving the base 32.

The bonding agent Bd can be applied so as to form a nearly ideal shape, that is to say thickly along the center of each barrier rib 18, and more thinly to the areas on either side of this strip, due to the bonding agent Bd being applied to the surface of the barrier ribs 18 using surface tension when the tops of the barrier ribs 18 are dipped in the bonding agent Bd.

In practice, however, there is a certain amount of variation in the heights of the barrier ribs 18, and differences in height can also be observed along the length of individual barrier ribs 18. This is caused, among other things, by a slight curvature in the glass plate on which the barriers ribs 18 are fixed, and by the conditions under which the barrier ribs 18 are formed.

FIG. 4 shows a situation in which this kind of unevenness in the height of the barrier ribs exists.

The above variation in the height of the barrier ribs 18 causes the consistency with which the bonding agent Bd is applied to the barrier ribs 18 to be influenced by the distance base 42 is moved, that is the degree to which the barrier ribs 18 are brought into contact with the paste layer 40.

Figure 4A:
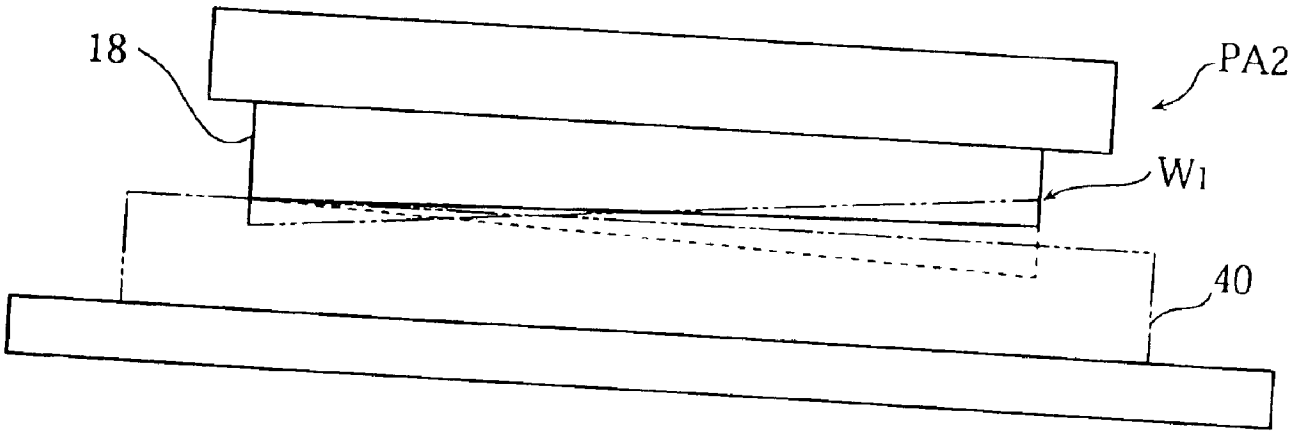
FIGS. 4A and 4B show situations in which the barrier ribs are of different heights.

This means that if the degree of contact of the barrier ribs 18 with the paste layer 40 is too low, as is shown in FIG. 4A, relatively low parts of the barrier ribs 18 will not be coated with the bonding agent Bd. This is likely to cause problems when the barrier ribs 18 are fixed to the front glass plate, and may produce a defective product unable to withstand high pressure.

Figure 4B:
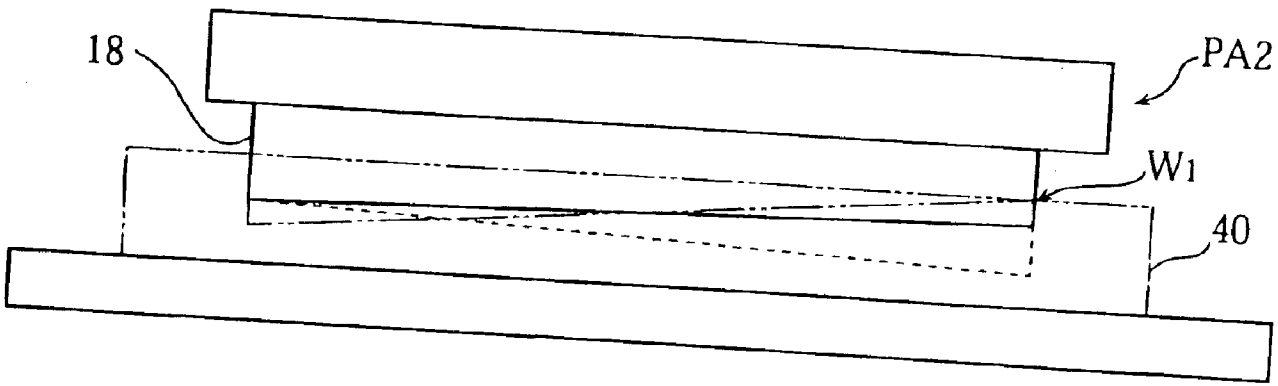

When the heights of the barrier ribs 18 vary in this way, a method described below may be used to adjust the degree of contact between the barrier ribs 18 and the paste layer 40 appropriately so that the bonding agent Bd can be applied without the variations in height affecting the result. FIG. 4B shows a method in which the bonding agent Bd is applied evenly to the entire upper surface of each barrier rib 18 by adjusting the amount that the base 42 is moved.

As shown in the drawing, all of the barrier ribs 18 can be evenly coated with the bonding agent Bd by moving the base 42 until the point at which the barrier ribs 18 are lowest (W1 in the drawing) is brought into contact with the paste layer 40.

If the bonding agent Bd is applied to all of the barrier ribs 18 using the method shown in FIG. 4B, the higher barrier ribs 18 have a larger degree of contact with the paste layer 40 and are thus coated with a larger amount of the bonding agent Bd than lower barrier ribs 18. This means that when the front substrate PA1 and the back substrate PA2 are sealed together, there will be greater seepage of the bond into cell areas corresponding to higher barrier ribs 18, as was described above. As a result, the light-emitting cell area is decreased, and luminance will probably fall.

Figure 5:
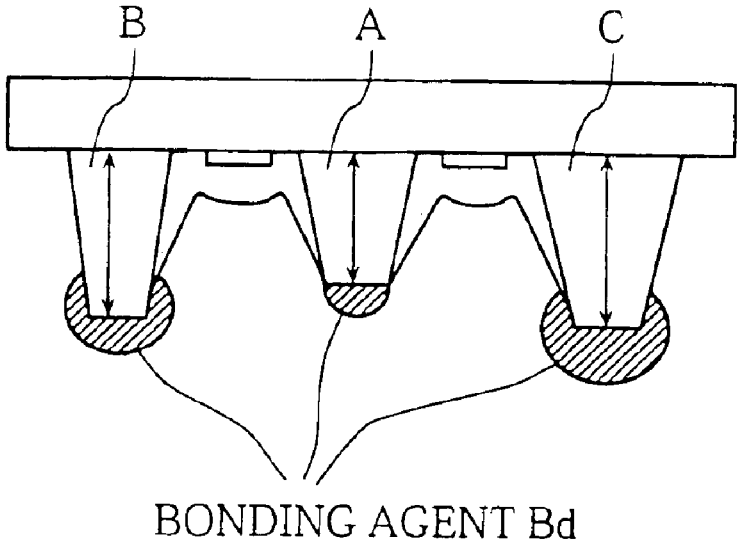
FIG. 5 shows how differences in the height of barrier ribs cause variations in the amount of coating applied.

With this in mind, the following is an explanation of how the amount of coating comes to vary with the height of the barrier ribs 18 with reference to the model representation in FIG. 5. The drawing shows a situation in which the amount of coating varies according to the height of the barrier ribs 18. As shown in the drawing, the amount of bonding agent Bd applied increases with the height of the barrier ribs 18 (in the order A, B, C, in the case of the barrier ribs in the drawing). When the front substrate PA1 and the back substrate PA2 are sealed together with the bonding agent Bd applied in this fashion, the bonding agent Bd applied to the barrier rib C will seep into a wider cell area than the bonding agent applied to the other barrier ribs A and B. Furthermore, if neighboring barrier ribs 18 both have a large coating of bonding agent Bd, the degree of seepage into the cell area between such barrier ribs 18 will be even greater than if only a singleton barrier rib 18 is affected.

Here, the tops 18*a* of the barrier ribs 18 may be reduced by polishing with a reduction device such sandpaper or a sander belt (a polishing device which supplies a continuous belt of sandpaper to a polishing part) or by grinding with a surface grinder. This minimizes variations in the heights of the barrier ribs 18. The tolerated degree of variation depends on how much influence the degree of seepage into the cell area after connection has on luminance, but to give one example, a variation of around 10 $\mu$m would be acceptable when the barrier ribs 18 are 100 $\mu$m in height.

In this sense, the meaning of the phrase the 'tops of the barrier ribs' as used in the present and subsequent embodiments refers not just to the upper surface 18*a*, but also to parts of the barrier rib sides 19*b* adjacent to the back substrate PA2 that are prone to some degree of bonding agent seepage. Note that the tops 18*a* of the barrier ribs 18 may also be ovoid, triangular or jagged in shape.

The polishing process may be performed on the tops 18*a* of the barrier ribs 18 either before or after the phosphor layer is formed. It is preferable to perform the process beforehand however, since this prevents dust created by the polishing or similar from lodging between the phosphor particles.

Once the bonding agent Bd has been applied to the tops 18*a* of the barrier ribs 18 as explained above, a similar bonding agent is applied to the perimeter of either the front substrate PA1 or the back substrate PA2 as a sealant.

Next, pre-firing takes place at a specified temperature of around say 350° C., in order to eliminate resinous components from the sealing paste applied to the perimeter of the substrates.

Then, the front substrate PA1 and the back substrate PA2 are placed in opposition with the discharge electrodes 12 and the address electrodes 16 at right angles. The substrates are then sealed together by firing at a specified temperature of, for example, 450° C.

Figure 6A:
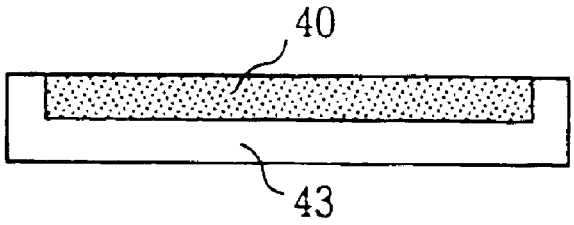
FIGS. 6A and B show variations in the shape formed by the layer of bonding agent.
Figure 6B:
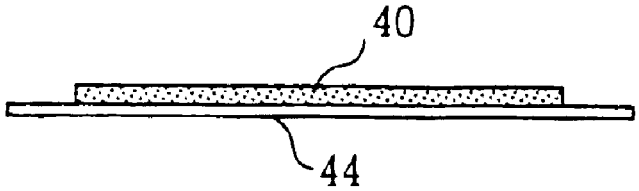

The paste layer 40 need not be formed on the flat plate 41, as long as its surface can be kept even. As shown in FIG. 6A, the paste layer 40 may be formed by filling a paste container 43 with the bonding agent Bd, and smoothing the surface using a squeegee or similar. Alternately, as shown in FIG. 6B, the bonding agent Bd may be applied evenly to the surface of a paste film 44 made from polyethylene or the like, which is used instead of the flat plate 41 to create an evenly-shaped layer.

Second Embodiment

This embodiment is characterized by a mechanism for adjusting the degree of contact between the bonding agent and the barrier ribs, so the following explanation focuses on this device.

Figure 7:
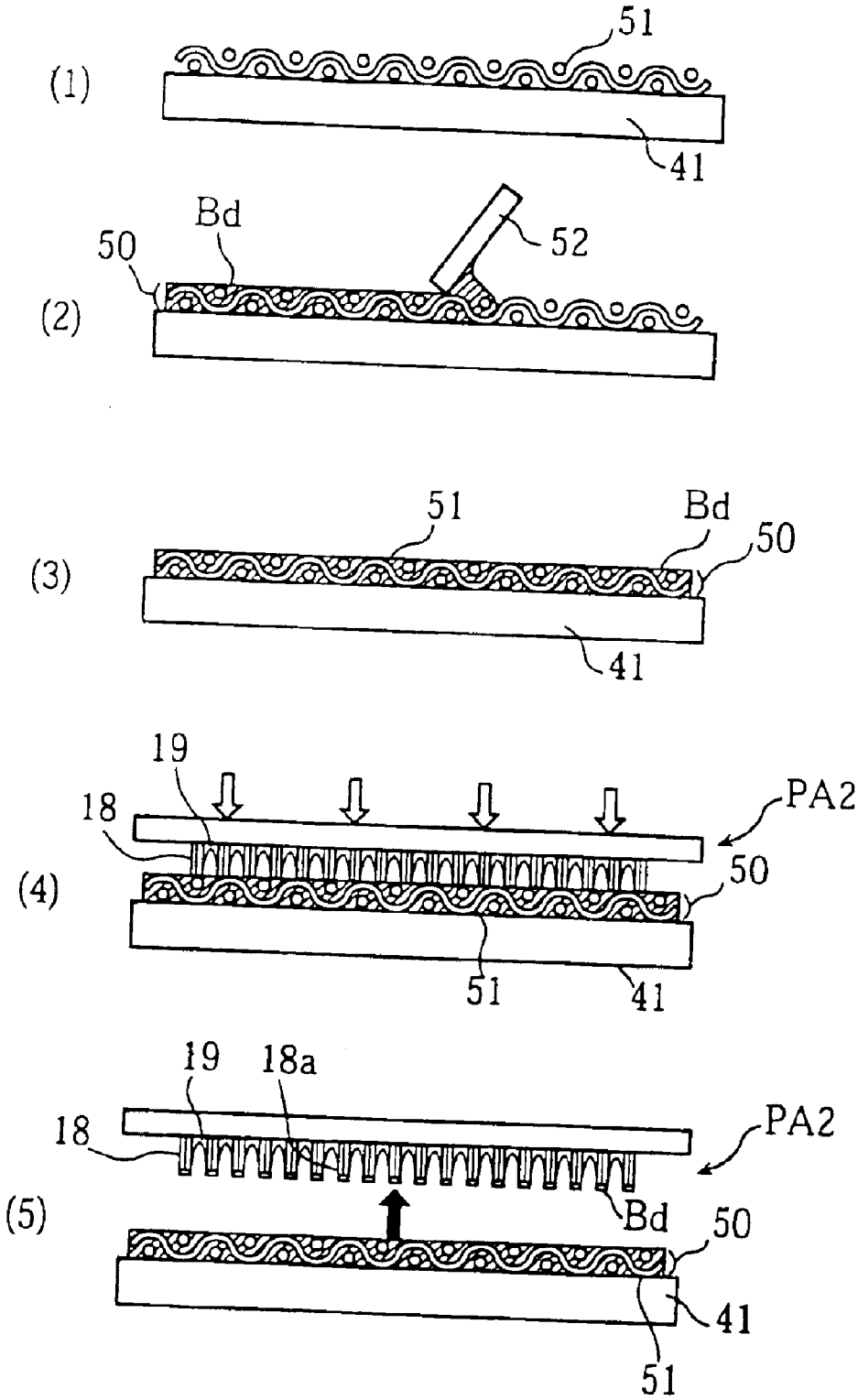
FIG. 7 illustrates a method used in another embodiment for arranging the bonding agent on the tops of the barrier ribs.

FIG. 7 shows a method for forming the bonding agent Bd on the tops of the barrier ribs 18. The processing sequence for applying the bonding agent Bd is performed in the order of the numbered stages (1) to (5).

First, in stage (1), mesh 51 is placed on the flat plate 41 (identical to that in FIG. 3). The mesh 51 is formed by weaving wire rods made of metal or a resin such as polyethylene together, with the wire rods spaced at specified intervals. A mesh of the size used in conventional screen-printing, such as a 325 mesh, may be used. It is preferable to use a finer mesh, however, since the reduction in the thickness of the wire rods used to construct the mesh 51 means that the mesh pattern is less likely to remain on the surface of the barrier ribs 18 when the bonding agent Bd is applied, enabling the bonding agent Bd to be applied evenly.

In stages (2) and (3), a squeegee 52 is used to apply the bonding agent Bd from the top surface of the mesh 51 (the upper side in the drawing) forming a paste layer 50 of the same thickness as the mesh 51. The paste layer 50 is held in place by the mesh 51. A specified amount of the bonding agent Bd is placed on one part of the mesh 51, and spread by moving the squeegee 52 across the surface of the mesh 51. Alternately, the paste layer 50 may be formed by using a printing means such as dye coating. The squeegee 52 may be made of rubber, but as a rubber squeegee leaves lines behind, a metal squeegee should preferably be used to obtain a more even finish.

In stage (4), a back substrate PA2, with the barrier ribs 18 and the phosphor layer 19 formed on its surface, is prepared. The barrier ribs 18 are then pushed into contact with the surface of the paste layer 50.

Here, the pressure brought to bear on the mesh 51 is sufficient to press down the mesh 51 to compensate for the variations in the height of the barrier ribs 18, ensuring that the bonding agent Bd is applied evenly to virtually all of the tops 18*a* of the barrier ribs 18.

Next, in stage (5), the back substrate PA2 is separated from the mesh 43.

By using the above process, the bonding agent Bd can be applied evenly to virtually the entire length of the top of each barrier rib 18, so that the paste layer 50 is formed in a shape similar to that of the ideal shape described above.

Figure 8:
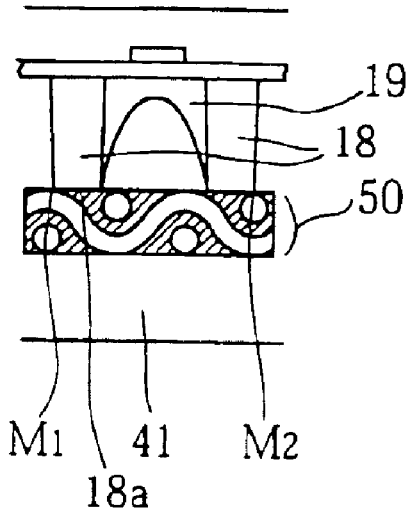
FIG. 8 illustrates the operation of a regulating means.

In this way, in the present embodiment, the mesh 51 serves as a regulator for regulating the degree of contact obtainable with the paste layer 50. FIG. 8 shows an enlargement of part of the mesh 51 in order to illustrate this process. As can be seen from the drawing, the degree of contact between the barrier ribs 18 and the paste layer 50 is regulated by the parts M1 and M2 where the barrier ribs 18 touch the mesh 51.

In other words, the paste layer 50 held in place by the mesh 51 used here is formed so as to be of the same thickness as the mesh 51. This means that when the barrier ribs 18 are pressed down, the tops 18*a* of the barrier ribs 18 are regulated by the parts M1 and M2 near to the surface of the paste layer 50, enabling the bonding agent Bd to be applied evenly to virtually the entire surface of the barrier rib tops 18*a*.

Note that the bonding agent Bd may splatter up from the surface of the mesh 51 when the mesh 51 is pressed down, but as long as the amount of the bonding agent Bd which seeps into the cell area is not sufficient to have a great impact on luminance, say of about 10 $\mu$m when the barrier ribs 18 have a height of 100 $\mu$m, this is acceptable.

Furthermore, the pattern of the mesh 51 is more likely to be left on the barrier ribs at places where the barrier ribs 18 and the mesh 51 come into contact, but this problem can be solved by repeating the above process.

The mesh pattern left on the barrier ribs 18 can also be eliminated by moving the back substrate PA2 horizontally along the length of the barrier ribs 18 while pressing it down onto the mesh 51. By moving the: back substrate PA2 in this way, the bonding agent Bd adheres to the parts of the barrier ribs 18 which were previously in contact with the mesh 51, and which were thus unable to receive a coating of bonding agent Bd.

The tops 18*a* of the barrier ribs 18 are often concave. If the bonding agent Bd cannot be applied to such concave top surfaces, the front substrate PA1 and the barrier ribs 18 will not be properly connected in these areas, lowering display quality. However, moving the front substrate PA1 in the way described above allows the bonding agent Bd to be applied to such indentations in the tops 18*a* of the barrier ribs, so that the front substrate PA1 and the back substrate PA2 can be more strongly bonded together.

Third Embodiment

This embodiment is characterized by a mechanism for pressing the barrier ribs against the mesh, so the following explanation concentrates on this mechanism.

Figure 9:
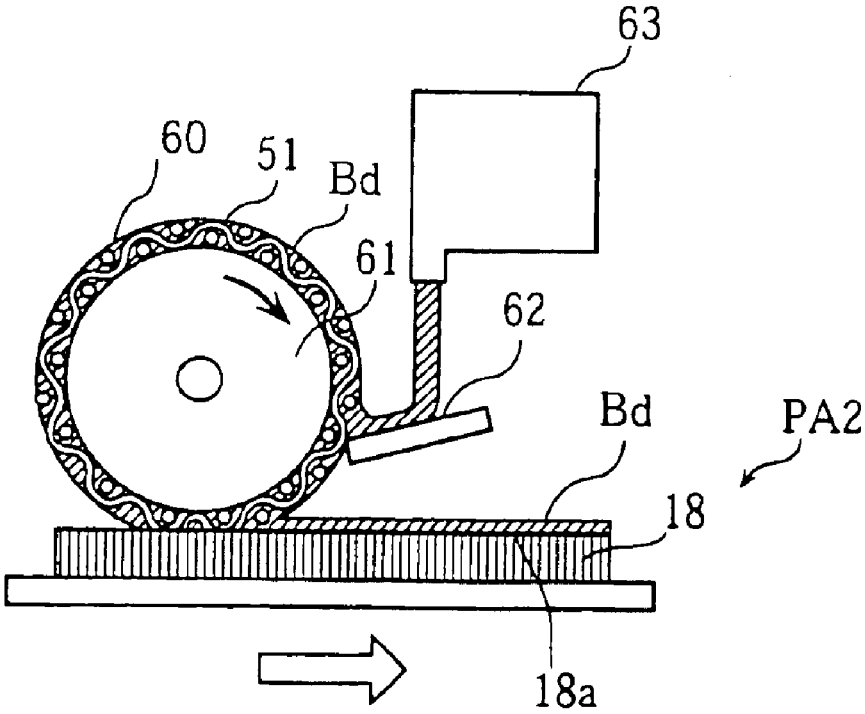
FIG. 9 illustrates a method used in another embodiment for arranging the bonding agent on the tops of the barrier ribs.

FIG. 9 illustrates a method used in the present embodiment for applying the bonding agent to the tops of the barrier ribs.

First, the mesh 51 (the same as in FIG. 7) is arranged on a surface of a cylindrical roller 61. Next, squeegees 62 are fitted against the surface of the mesh 51 and the bonding agent Bd fills up the mesh 51 arranged on the surface of the roller 61, forming a paste layer 60 held in place by the mesh 51. The bonding agent Bd is supplied in an appropriate amount onto the squeegees 62 from a tank 63.

Then, the roller 61 is pressed onto the back substrate PA2 on which the barrier ribs 18 and the phosphor layer 19 have been formed. By moving the back substrate PA2, the entire length of each barrier rib 18, starting from one end of the barrier ribs 18, is brought into contact with the mesh 51, applying the bonding agent Bd evenly to almost the entire top surface 18*a* of each barrier rib 18, producing a shape close to that of the ideal shape.

Here, it is preferable that the roller 61 is pressed against the back glass panel 43 using a back-up roller (not shown) arranged in parallel with the roller 61. The direction in which the back substrate PA2 moves may be a direction in which it is pushed by the roller 61 or a direction counter to that of the roller 61. The drawing shows the latter situation.

An attachment base, which grips the back substrate PA2, and fixes it in place, may be used instead of the back-up roller as the mechanism for pressing the mesh 51 onto the back substrate PA2. Although not shown in FIG. 9, the width of the mesh 51 corresponds to the width of the substrate PA2, enabling the mesh 51 to come into contact with all of the barrier ribs. The same applies to the mesh in the following embodiments.

Fourth Embodiment

This embodiment is characterized by a mechanism for pressing the barrier ribs against the mesh, so the following is an explanation of this mechanism.

Figure 10:
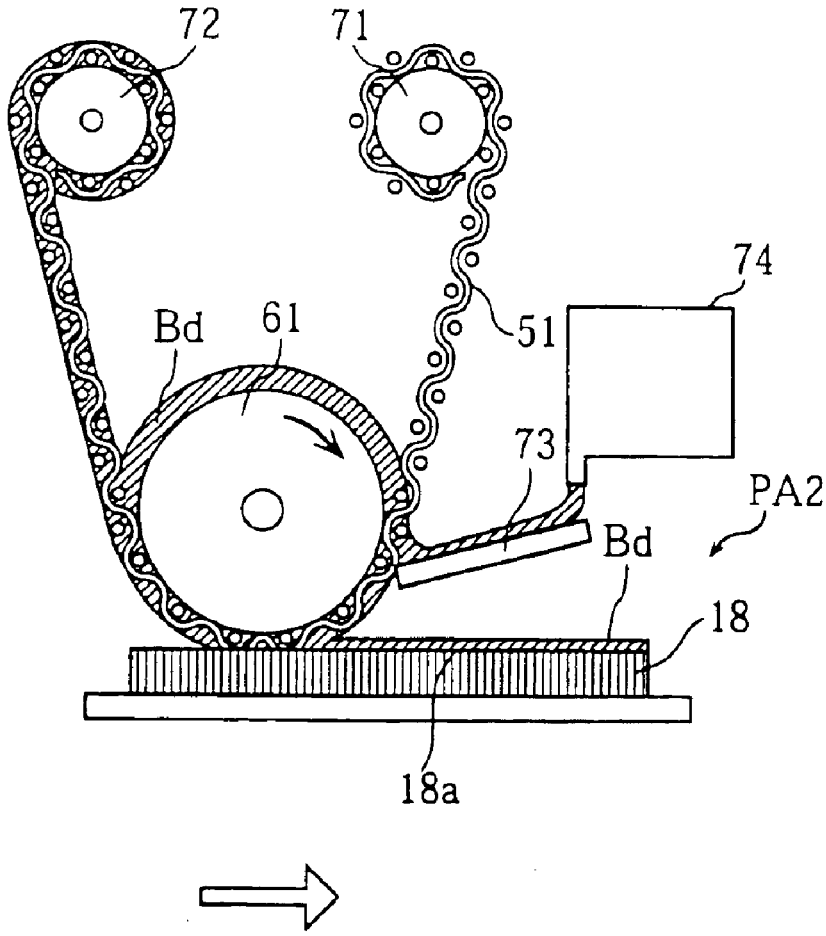
FIG. 10 illustrates a method used in another embodiment for arranging the bonding agent on the tops of the barrier ribs.

FIG. 10 illustrates a method for applying the bonding agent to the tops of the barrier ribs in the present embodiment.

As shown in the drawing, the mesh 51 has a belt-like structure, running between a roller 71 and a roller 72 via a roller 61. A squeegee 73 is arranged at a position where the mesh 51 wound out from the roller 71 touches the roller 61, enabling the bonding agent to fill up the mesh 51, which holds the layer of bonding agent in place. A tank 74 supplies an appropriate amount of bonding agent Bd onto the squeegee 73.

If the back panel PA2, complete with barrier ribs 18 and the like, is moved horizontally, the mesh 51 filled with bonding agent Bd comes into contact with each of the barrier ribs 18 in turn. This enables the bonding agent Bd to be applied evenly to the virtually the entire length of the top surface of each barrier rib 18, so that the shape formed is similar to the ideal shape.

Figure 11:
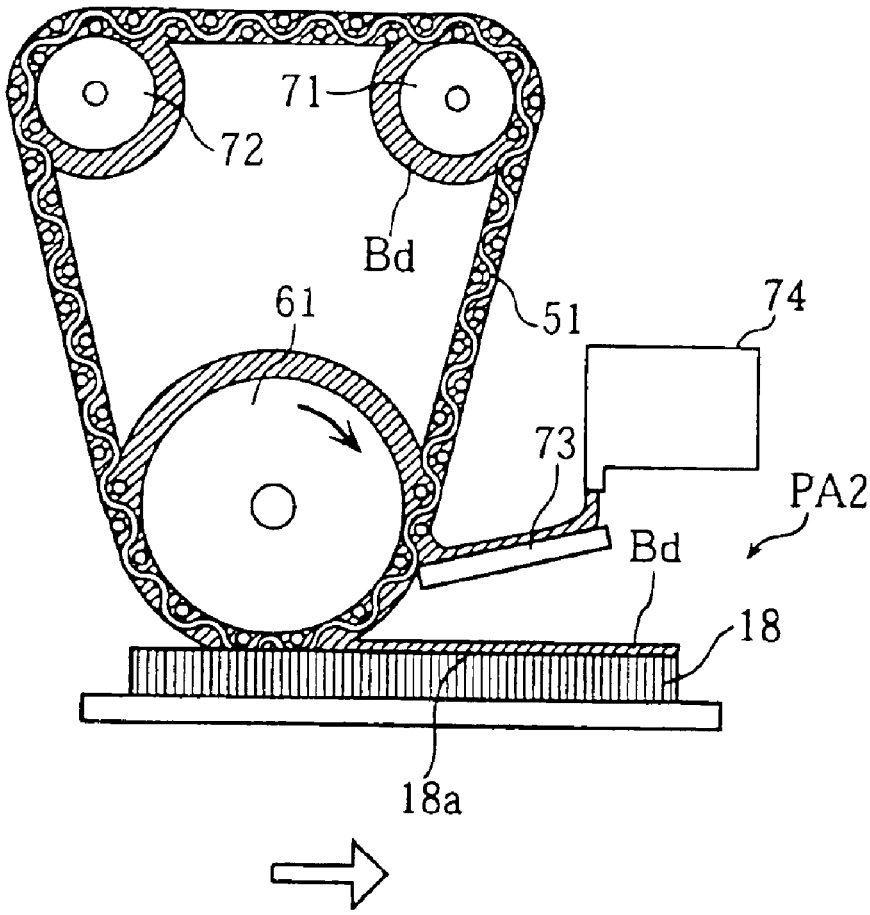
FIG. 11 illustrates a method used in another embodiment for arranging the bonding agent on the tops of the barrier ribs.

The mesh 51 may also be run over the rollers 71, 61 and 72 using an endless belt-like structure like the one shown in FIG. 11.

Here, as in the third embodiment, the roller 61 should preferably be pressed against the back substrate PA2 using a back-up roller. The direction in which the back substrate PA2 moves may be a direction in which it is pushed by the roller 61 or a direction counter to that of the roller 61. The drawing shows the latter situation. Also, as in the third embodiment, an attachment base, which grips the back substrate PA2, fixing it in place, may be used instead of the back-up roller as the mechanism for pressing the mesh 51 onto the back substrate PA2.

Fifth Embodiment

This embodiment is characterized by a mechanism for pressing the barrier ribs against the mesh, so the following explanation focuses on this mechanism.

Figure 12:
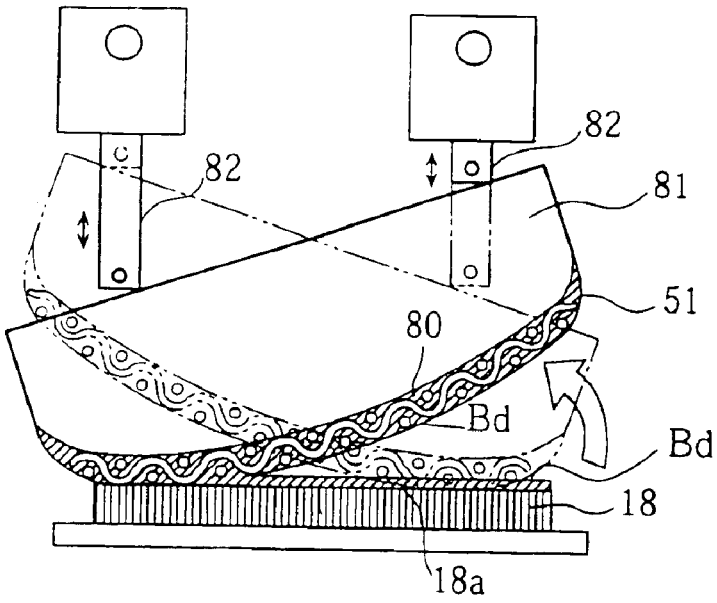
FIG. 12 illustrates a method used in another embodiment for arranging the bonding agent on the tops of the barrier ribs.

FIG. 12 illustrates a method for forming the bonding agent Bd on the tops of the barrier ribs 18 in the present embodiment.

Here, a base 81 with a smooth curved surface is used instead of the roller 61 shown in FIG. 9. The mesh 51 is arranged on the curved surface of the base 81. Next, the surface of the mesh 51 is filled by the bonding agent Bd using a squeegee or similar as explained above, forming a paste layer 80 held in place by the mesh 51.

Then the bonding agent Bd is applied to the surface of the back substrate PA2, on which barrier ribs 18 have been formed, by pressing the base 81 onto the surface of the back substrate PA2 so that it rocks back and forth between the location shown by the solid lines and the location shown by the dotted lines in FIG. 12. This enables the bonding agent Bd to be applied evenly to virtually the entire length of the top surface of each barrier rib 18, so that the shape formed is similar to the ideal shape.

FIG. 12 shows one example of a method for moving the base 81. In this method a pair of cylinders 82 capable of movement on a vertical plane are attached to either end of the base 81. Moving the cylinders 82 in different directions at an appropriate speed makes it possible to move the base 81 up and down. The driving mechanism for the cylinders may be of a hydraulic pressure, pneumatic pressure or mechanical type.

As an alternative, the base 81 may be fixed and the back substrate PA2 rocked back and forth.

Sixth Embodiment

This embodiment is characterized by a mechanism for pressing the barrier ribs against the mesh, so the following explanation focuses on this mechanism.

Figure 13:
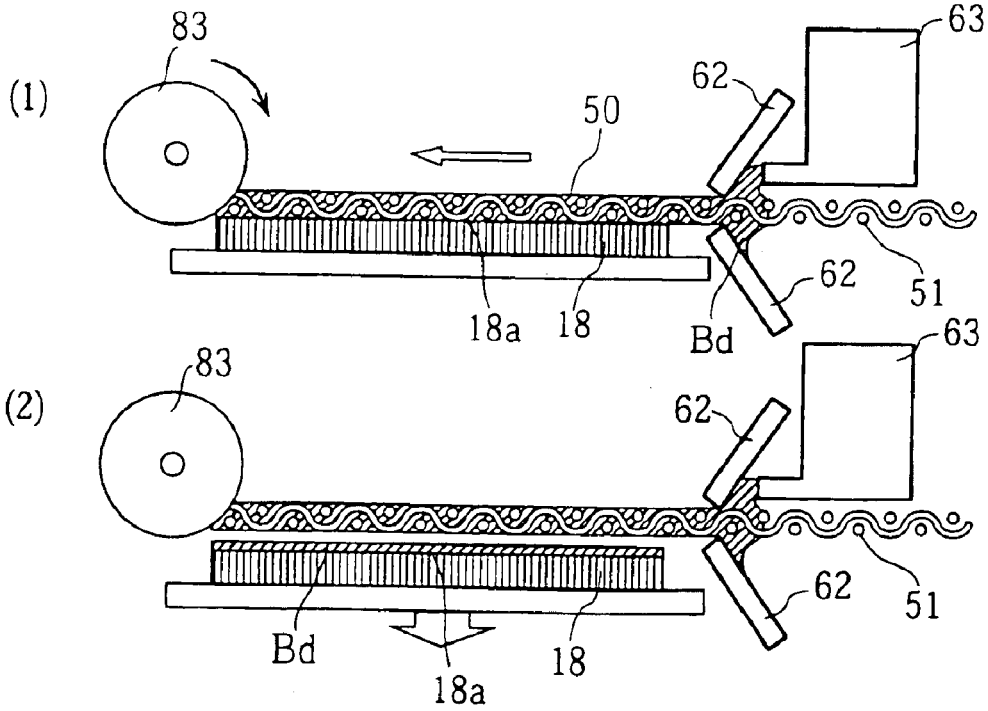
FIG. 13 illustrates a method used in another embodiment for arranging the bonding agent on the tops of the barrier ribs.

FIG. 13 is a drawing illustrating a method used in the present embodiment for forming the bonding agent Bd on the tops of the barrier ribs 18.

In the examples given in the previous embodiments, the mesh 51 is arranged on the surface of a rigid body, such as a flat plate or a roller. However, the bonding agent Bd may also be applied to the barrier ribs 18 by filling the mesh 51 with the bonding agent Bd and bringing the mesh 51 alone into contact with the surface before lifting it away again. This process is shown in FIG. 13, stages (1) and (2). This enables the bonding agent Bd to be applied evenly to virtually the entire length of the top surface 18*a* of each barrier rib 18, so that the shape formed is similar to the ideal shape. A tank 63 supplies an appropriate amount of bonding agent onto squeegees 62.

As shown in FIG. 13, the mesh 51 is brought into contact with the tops 18*a* of the barrier ribs 18 while being wound onto a roller 83. The mesh 51 is lifted away from the barrier ribs 18 after the winding roller has been stopped.

In this example, the mesh 51 may be slid across the tops of the barrier ribs 18 or the back panel PA2 may be slid across the mesh 51.

Seventh Embodiment

The method for applying the bonding agent in this embodiment is performed by bringing the barrier ribs 18 into partial contact with the bonding agent Bd and then moving the back substrate PA2 so that the surface tension between the barrier ribs 18 and a paste layer 90 allows the bonding agent to be applied along the entire length of the barrier ribs 18.

Figure 14:
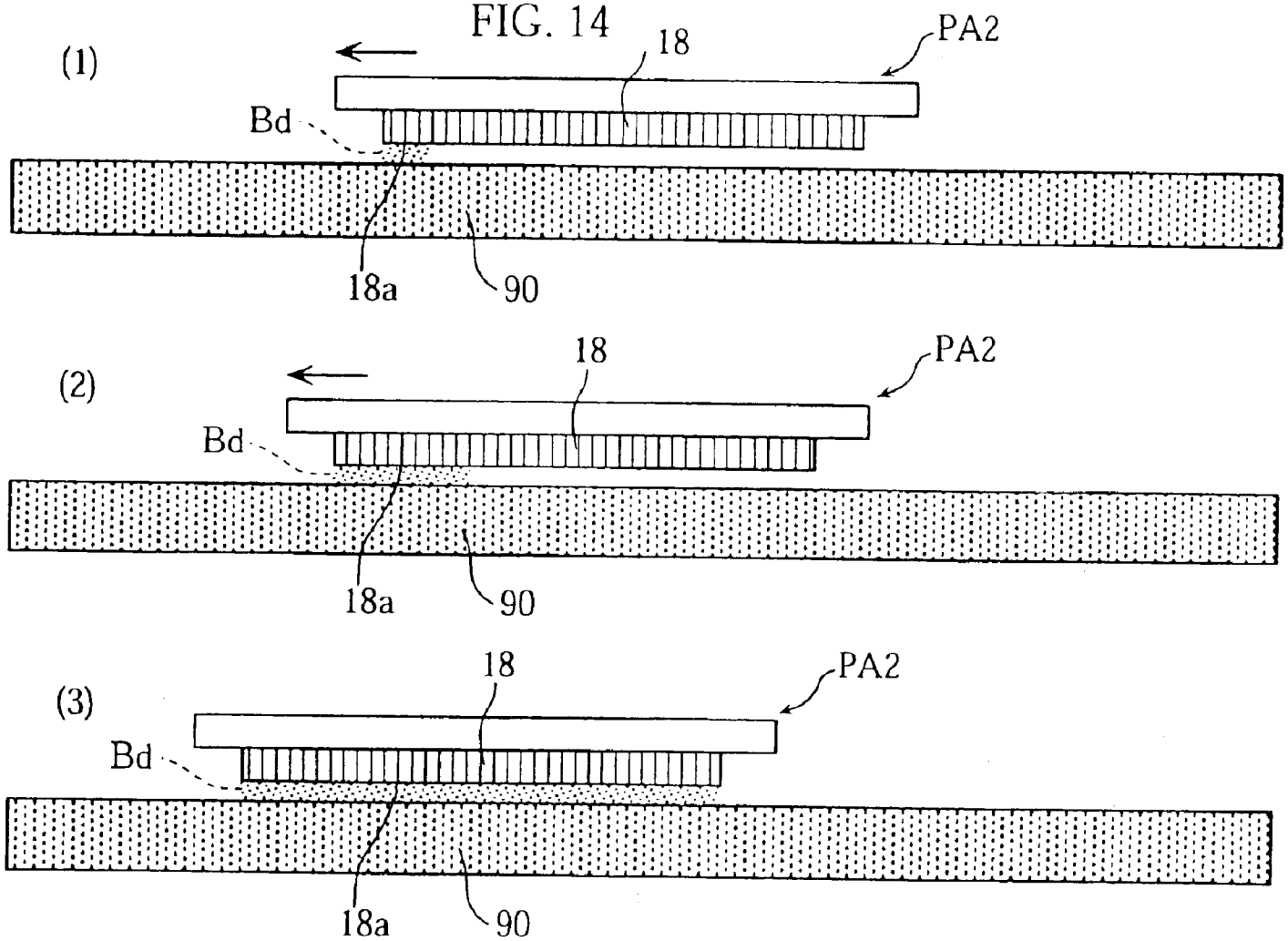
FIG. 14 illustrates a method used in another embodiment for arranging the bonding agent on the tops of the barrier ribs.

FIG. 14 illustrates this method. Note that only one barrier rib is shown for the sake of simplicity.

In stage (1), one end of the upper surface 18*a* of the barrier rib 18 is dipped in a paste layer 90. The barrier rib 18 is then separated from the paste layer 90 by a certain distance that allows the bonding agent Bd to adhere to the dipped part of the rib 18 due to surface tension.

Next, as shown in stages (2) and (3), the back substrate PA2 on which the barrier rib 18 is formed is moved across the surface of the paste layer 90, preserving the surface tension connecting the bonding agent Bd to the barrier rib 18. The bonding agent Bd may be applied along the barrier rib 18 by moving the back substrate PA2 in the direction of the part of the rib as yet uncovered by the bonding agent Bd, or in the opposite direction. This enables the bonding agent Bd to be applied to virtually the entire surface of the tops 18*a* of the barrier ribs 18 using surface tension.

Figure 15:
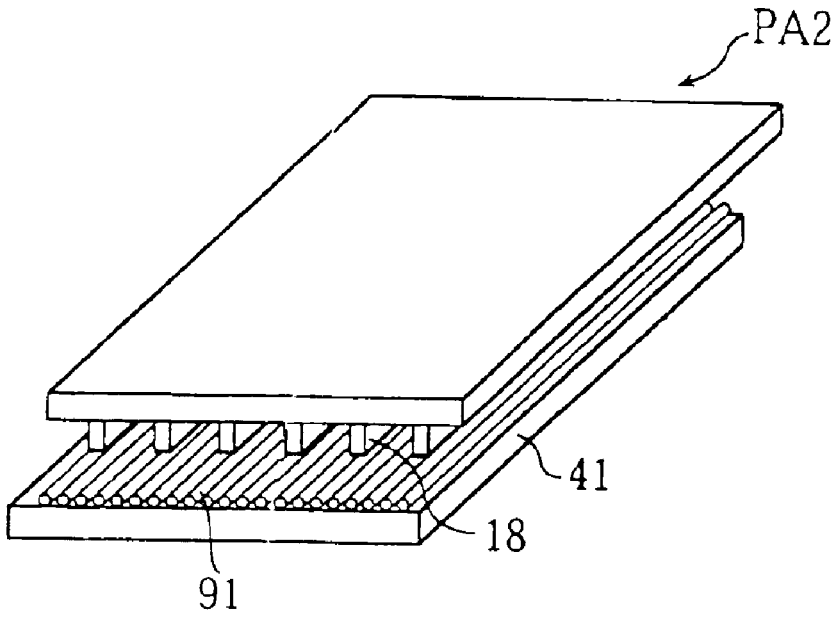
FIG. 15 shows an alternative regulating means.

Note that a device like the one shown in FIG. 15, in which wire rods 91 are lined up regularly in a stripe formation, may be used instead of a mechanism in which the mesh 51 is placed on the roller 61, the flat plate 41, or similar. If the gaps between the wire rods 91 are filled with the bonding agent Bd, the degree of contact between the bonding agent Bd and the barrier ribs 18 can be regulated by bringing the barrier ribs 18 into contact with the wire rods 91, obtaining a similar effect to that described above. The wire rods 91 should be arranged at a narrower pitch than the barrier ribs 18, ideally at a pitch obtained by dividing the pitch of the barrier ribs 18 by an integer. This makes it easier to locate the tops 18*a* of the barrier ribs 18 at a gap between two wire rods 91, in other words an area containing the bonding agent Bd, as can be seen from FIG. 18.

Alternatively, a device formed from a sheet of resin of an equal thickness, having a surface covered with slight protrusions and indentations, or a device in which protrusions and indentations of the same height are formed directly on the surface of the flat plate 41, may be used. The protrusions and indentations on the surface of the resin may be formed by etching or by a molding machine.

Figure 16:
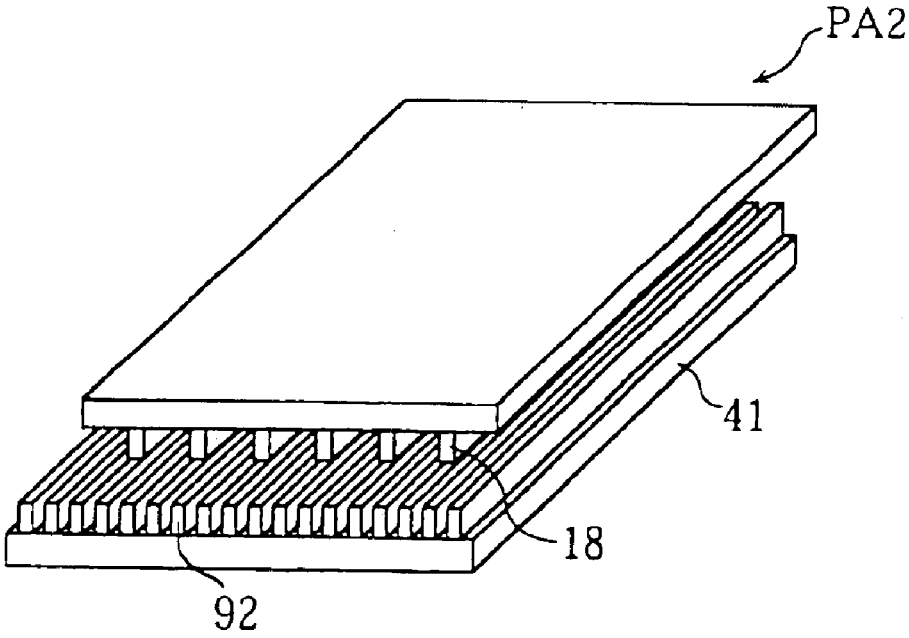
FIG. 16 shows an alternative regulating means.
Figure 17:
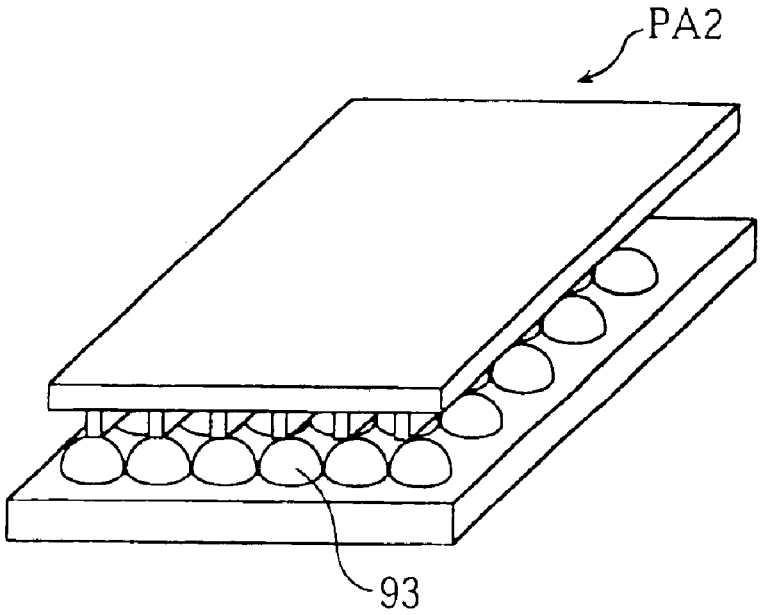
FIG. 17 shows an alternative regulating means.

Other alternatives are shown in FIGS. 16 and 17. FIG. 16 shows a device formed by lining up a plurality of rectangular solids 92 on the surface of the flat plate 41. FIG. 17 shows a device formed by lining up a plurality of approximate semi-hemispheres 93 on the surface of the flat plate 41.

Figure 18:
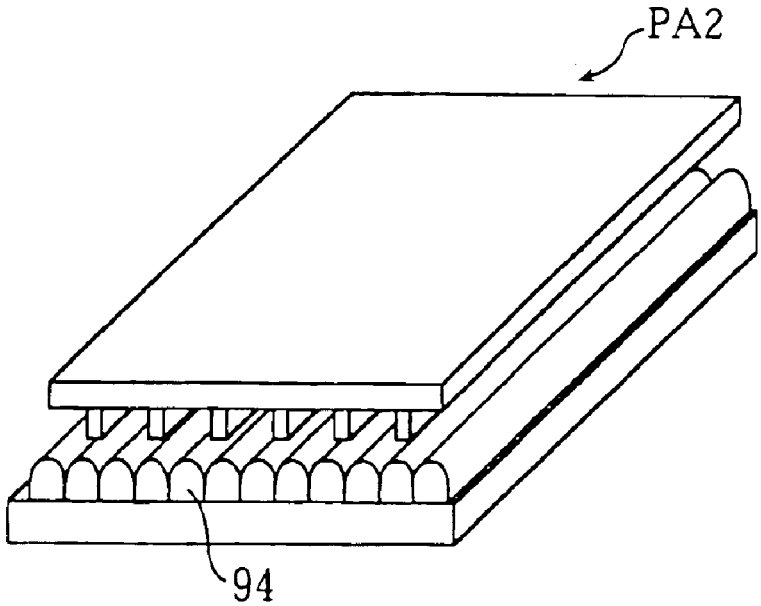
FIG. 18 shows an alternative regulating means.

Alternatively, a plurality of half-cylinders 94 may be lined up on the surface of the flat plate 41, as shown in FIG. 18. In this case, the half-cylinders 94 should be lined up lengthwise at regular intervals, at a pitch narrower than the pitch of the barrier ribs 18, and ideally at a pitch obtained by dividing the pitch of the barrier ribs 18 by an integer. This means that the tops of the barrier ribs 18 are lined up with the valleys between each of the half-cylinders 94, as shown in FIG. 18. In other words, the above structure makes it easier to position the barrier ribs at locations containing the bonding agent Bd.

Note that the bonding agent application in the above first to seventh embodiments may be performed either before or after the phosphor layer is formed between the barrier ribs.

Eighth Embodiment

This embodiment is characterized by a method for arranging the bonding agent on the tops of the barrier rubs, so the following explanation focuses on this method.

Figure 19:
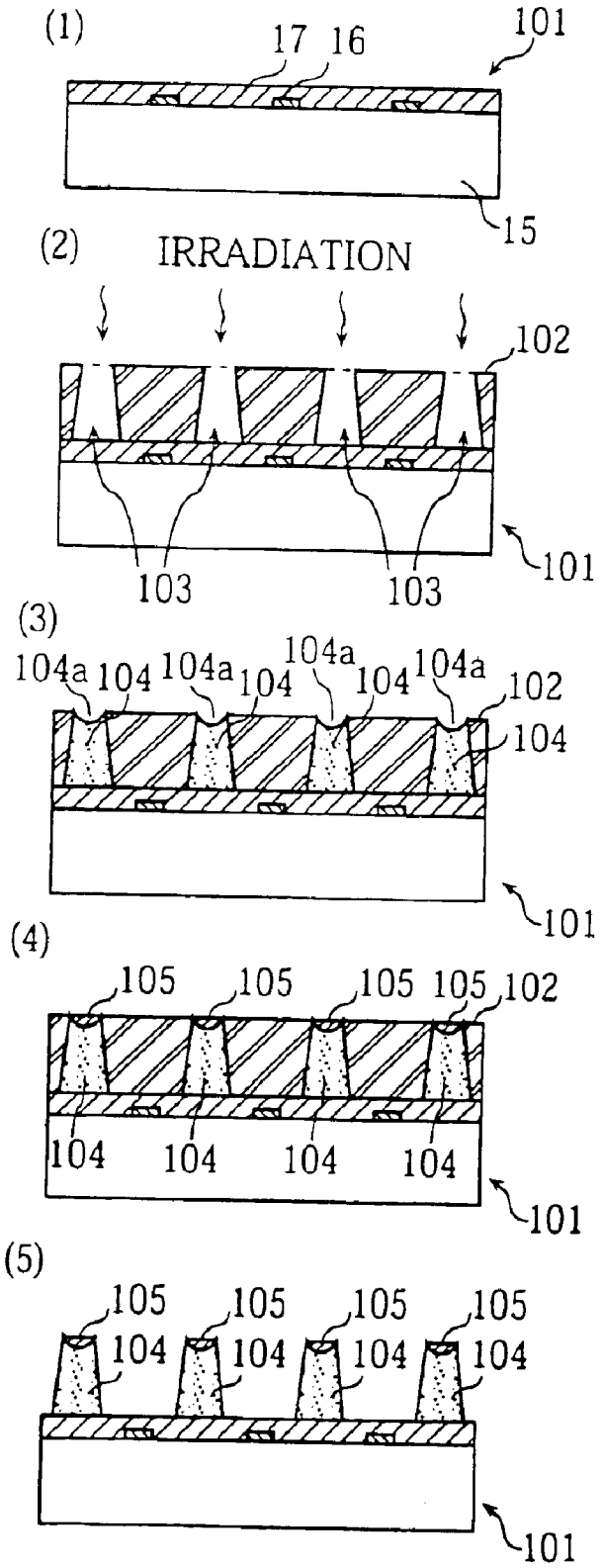
FIG. 19 illustrates a method used in another embodiment for arranging the bonding agent on the tops of the barrier ribs.

FIG. 19 is a process diagram showing a method for arranging the bonding agent in the present embodiment. The processing sequence is performed in the order of stages (1) to (5).

In stage (1), a base plate 101 in which the address electrodes 16 and the visible light reflecting layer 17 are formed on top of the back glass plate 15 is prepared. Following this, in stage (2), photosensitive film 102 is fixed to the surface of the base plate 101. Then apertures 103 are formed in the photosensitive film 102 by exposing and developing a specific pattern, so that a pattern for the barrier ribs is obtained.

Next, in stage (3), a barrier rib forming paste 104 (hereafter referred to as a barrier rib paste) for making the barrier ribs 18 is introduced into the apertures 103 and then dried.

Following this, in stage (4), a bond paste 105 made of the bonding agent is introduced on top of the barrier rib paste 104 and dried. This creates a formation in which the barrier ribs 18 and the bonding agent Bd are laminated. Note that when the barrier rib paste 104 is introduced, a round indentation 104*a* is formed along the center of each barrier rib 18, as shown in stage (3).

In stage (5), the structure is transferred onto the base plate 101 by eliminating the photosensitive film 102.

The structure is then fired, forming barrier rib and bonding agent layers, the layer of bonding agent Bd being arranged evenly along the barrier rib tops.

In general, the firing temperature for the barrier rib paste is higher than that for the bonding agent Bd, so that in the above process the bonding agent Bd is heated at a temperature higher than its softening point. Accordingly, if the surface on which the barrier ribs 18 are formed is placed face down during firing, the bonding agent Bd can be prevented from seeping into the barrier rib side.

Note that the bonding agent application in this embodiment may be performed either before or after the phosphor layer is formed between the barrier ribs.

Ninth Embodiment

This embodiment is characterized by a method for arranging the bonding agent on the tops of the barrier ribs, so the following explanation focuses on this method.

Figure 20:
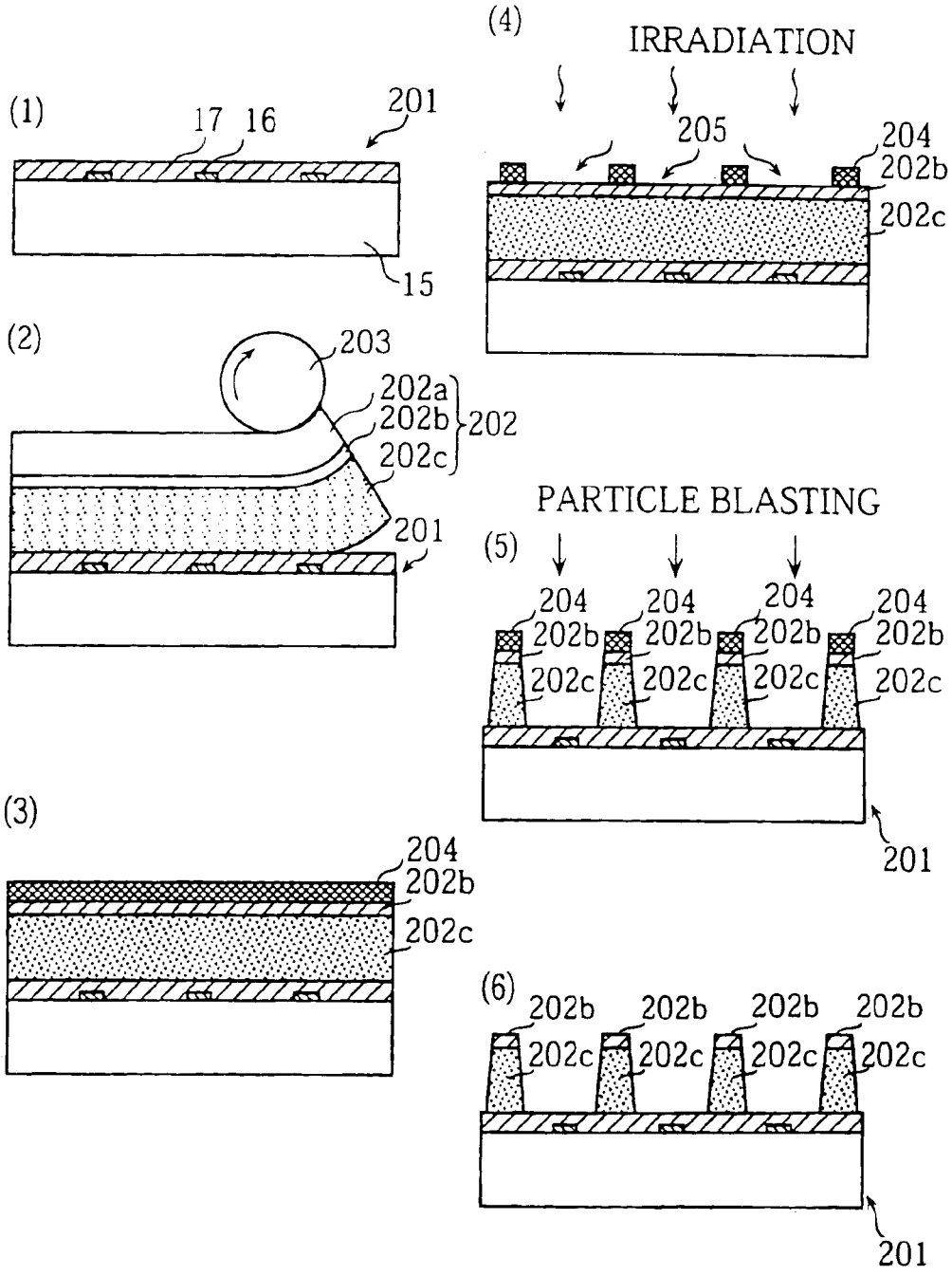
FIG. 20 illustrates a method used in another embodiment for arranging the bonding agent on the tops of the barrier ribs.

FIG. 20 is a process diagram showing a method for arranging the bonding agent in the present embodiment. The processing sequence is performed in the order of the stages (1) to (5).

In stage (1), a base plate 201, in which the address electrodes 16 and the visible light reflecting layer 17 are formed on top of the back glass plate 15 is prepared.

Next, in stage (2), a green sheet 202 is applied to the surface of the base plate 201 using a roller 203. The green sheet 202 is formed from a resinous film 202*a*, a bonding paste layer 202*b* and a barrier rib paste layer 202*c*. The resinous film 202*a* is formed from PET resin (polyethylene terephthalate) or similar. The bonding paste layer 202*b* may be formed by dispersing a glass frit with a low softening point and acrylic resin (IBM-1 developed by Sekisui Plastics Co.,Ltd) in 2-butanone. The barrier rib paste layer 202*c* may be formed from a composite of an inorganic filler, glass frit and acrylic resin.

The green sheet 202 is manufactured in the following way. First, a coating of the bonding paste having a specified thickness of, for example, 10 $\mu$m is applied on top of the resinous film 202*a* using a printing method such as a coater method, and then dried to form the bonding paste layer 202*b*. Next, a coating of the barrier rib paste having a specified thickness of, for example, 120 $\mu$m is applied on top of the bonding paste layer 202*b* and then dried to form the barrier rib paste layer 202*a*.

Following this, in stage (3), the resinous film 202*a* is peeled off from the green sheet 202 and the remaining layers are pre-fired. After this, a photosensitive film 204 is applied to the top of the bonding paste layer 202*b*.

Next, in stage (4), apertures 205 are formed in the photosensitive film 204 by exposing and developing a specific pattern, so that apertures 205 are formed in a pattern corresponding to the pattern of the barrier ribs 18 and the bonding agent Bd.

Then, in stage (5), the green sheet 202 is removed from beneath the apertures 205 created in the photosensitive film 204 patterned as described above. This process is performed by blowing minute particles of silica or similar against the surface of the green sheet 202 using a sandblasting method. A structure in which the barrier ribs 18 and bonding agent Bd have been laminated is obtained.

In (6), the photosensitive film 204 is removed, transferring the aforementioned structure onto the base plate 201.

Finally, this structure is fired, forming barrier rib and bonding agent layers, the layer of bonding agent being arranged evenly along the barrier rib tops. Note that if the surface on which the barrier ribs 18 are formed is placed face down during this firing process, the bonding agent can be prevented from seeping into the barrier rib side.

In this embodiment the green sheet consisted of three layers including a resinous film, but the resinous film is a backing sheet, which need not be used.

Furthermore, the barrier rib paste and the bonding paste may be applied using a printing method rather than the green sheet.

Tenth Embodiment

This embodiment is characterized by a method for arranging the bonding agent on the tops of the barrier ribs, so the following explanation concentrates on this method.

Figure 21:
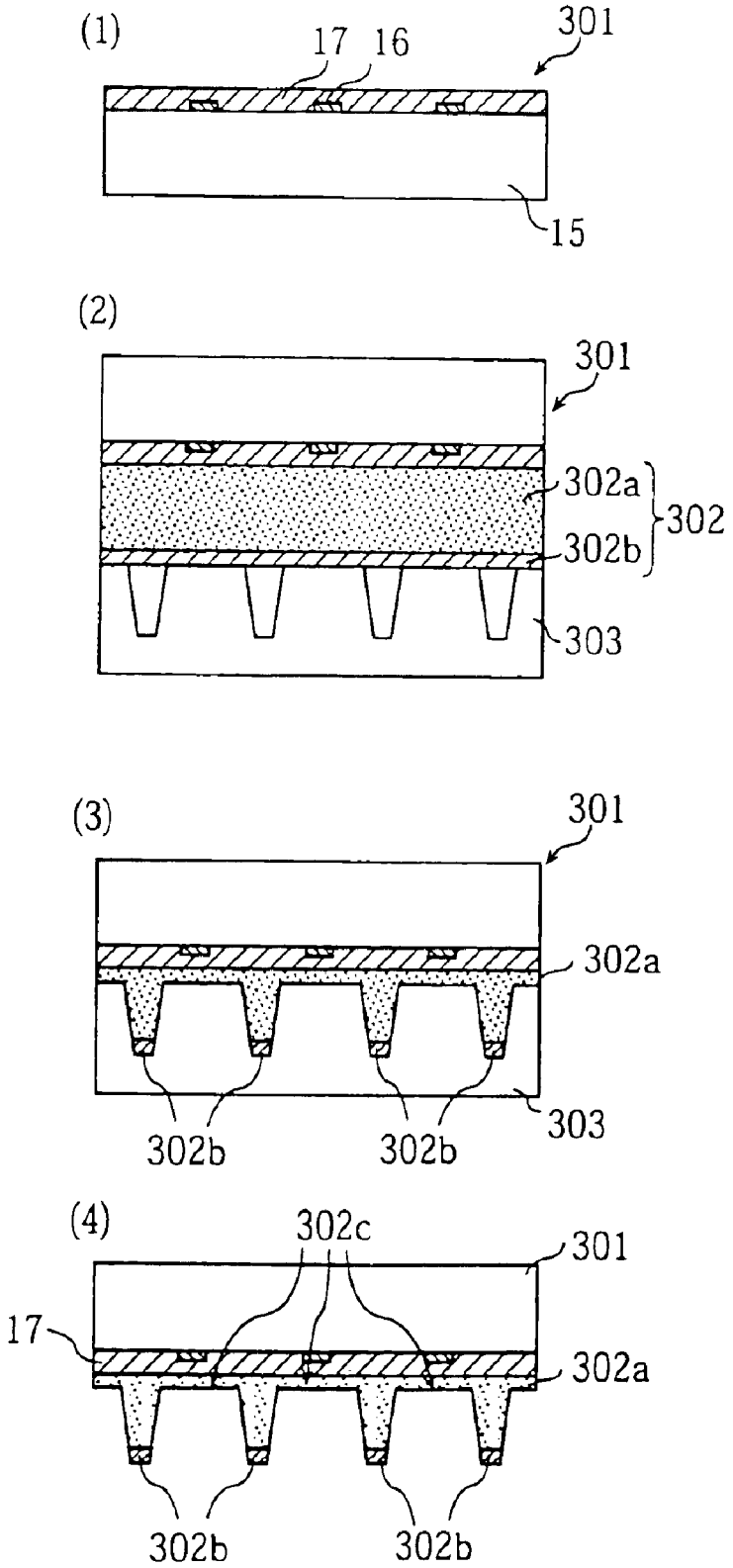
FIG. 21 illustrates a method used in another embodiment for arranging the bonding agent on the tops of the barrier ribs.

FIG. 21 is a process diagram showing the method for arranging the bonding agent in the present embodiment. The processing sequence is performed in the order shown by stages (1) to (4).

In stage (1), a base plate 301 in which the address electrodes 16 and the visible light reflecting layer 17 are formed on top of the back glass plate 15 is prepared.

Following this, in stage (2), the base plate 301 is placed, with the surface on which the address electrodes 16 have been formed facing downwards, on a metal mold 303 with a green sheet 302 sandwiched in between. The green sheet 302 is formed from a bonding paste layer 302*a* and a barrier rib paste layer 302*b*, so that a green sheet that is identical to the green sheet 202 with the resinous film omitted may be used. The metal mold 303 is formed in the shape of the barrier rib pattern.

Next, stage (3), the green sheet 302 is pushed down by the base plate 301. This is performed with the base plate 301 and the metal mold 303 heated to a temperature that is sufficient to melt the green sheet 302. This produces a structure in which the barrier ribs 18 and the bonding agent Bd have been laminated.

In stage (4), the temperature is lowered to one at which the green sheet 303 is no longer fluid, and the base plate 301 is separated from the metal mold 303, transferring the aforementioned structure onto the base plate 301.

Finally, this structure is fired, forming barrier rib and bonding agent layers, the layer of bonding agent being arranged evenly along the barrier rib tops 18*a*. Note that pressure causes the bonding agent Bd located at areas other than the barrier rib tops 18*a* to be mixed in with the material used to form the barrier ribs 18, so that a layer of bonding agent is formed on the barrier rib tops 18*a* and not anywhere else on the surface of the barrier rib material. Furthermore, the surface on which the barrier ribs 18 have been formed should preferably be placed face down during the firing process, as was the case in the eighth embodiment.

Additionally, when the pattern of the barrier ribs 18 and bonding agent Bd is formed using a metal mold, as shown in stage (4), the material used to form the barrier ribs 18 is left on the surface of the light reflecting layer 17 in the gaps between the barrier ribs 18 shown by 302*c* in the drawing). This material may be removed by a method such as post-pattern-formation cutting.

Eleventh Embodiment

This embodiment is characterized by a metal mold used in a method for arranging the bonding agent on the tops of the barrier ribs, as in the tenth embodiment, so the following explanation concentrates on this metal mold.

Figure 22:
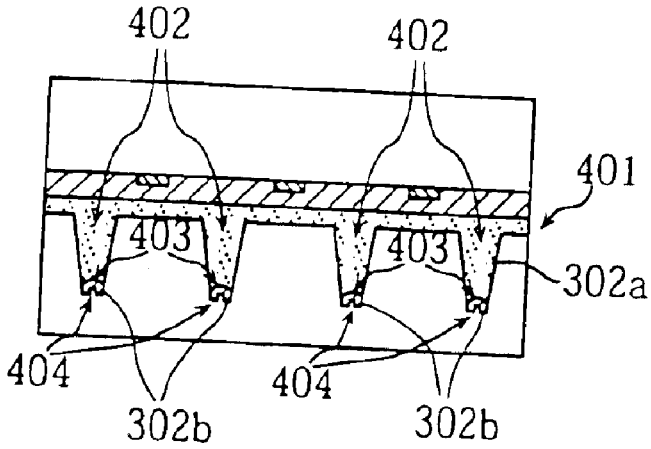
FIG. 22 is a cross-sectional drawing showing the shape of a metal mold in another embodiment.

In the present embodiment, the metal mold has a unique shape, as shown in FIG. 22. In other words, the metal mold 401 is shaped so that an even protrusion 404 is formed along the length of the bottom part 403 of each of the troughs 402 which make up the pattern for the barrier ribs.

Accordingly, in the process for pushing down the base plate onto the metal mold 401, the green sheet is pushed down by a base plate, inserting the bonding agent 302*b* into the indentations on either side of the protrusion 404, as shown in FIG. 22. This determines the location of the barrier ribs 18 and the bonding agent Bd, so that the bonding agent Bd is arranged more accurately on the barrier ribs 18.

Note that the protrusions 404 need not be formed along the entire length of the bottom part 403 of each barrier rib 18, but may instead be placed at intervals.

Twelfth Embodiment

This embodiment is characterized by a method for arranging the bonding agent on the tops of the barrier ribs, so the following explanation concentrates on this method.

Figure 23:
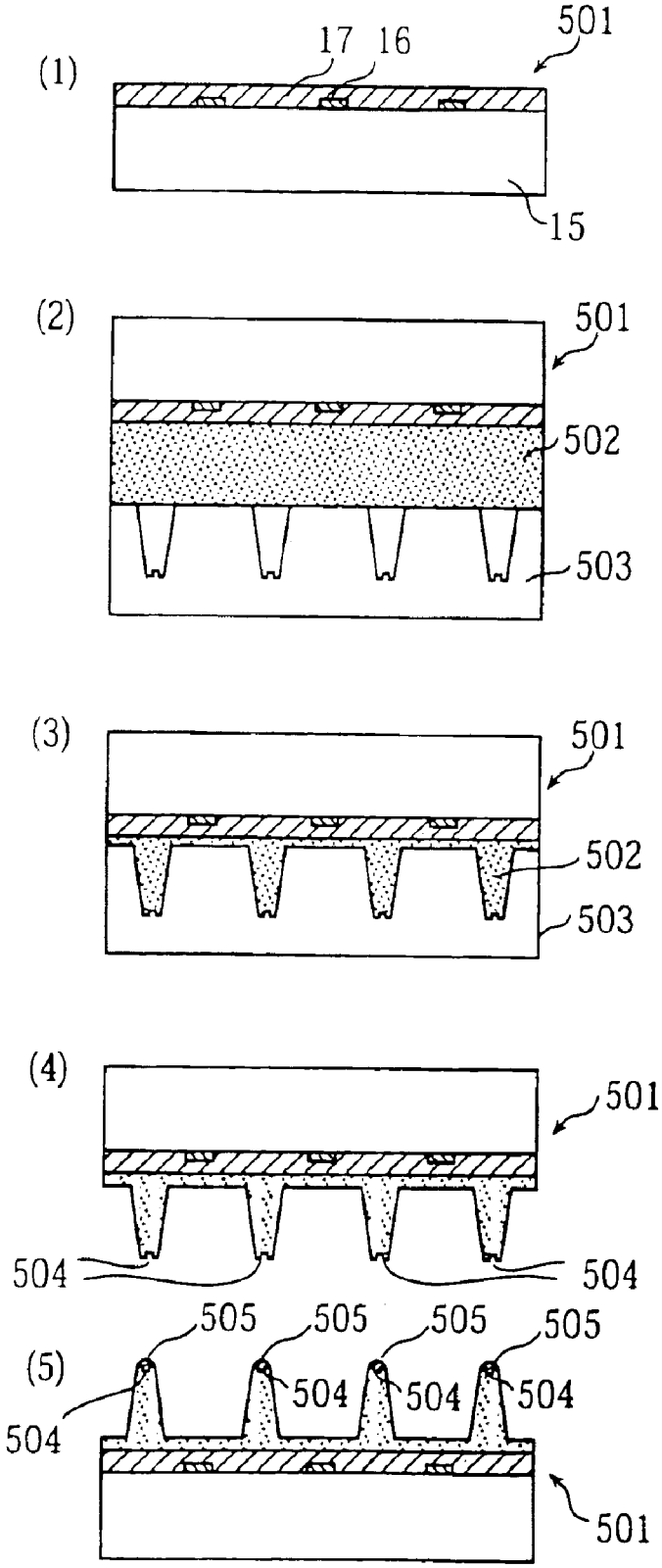
FIG. 23 illustrates a method used in another embodiment for arranging the bonding agent on the tops of the barrier ribs.

FIG. 23 is a process diagram showing the method for arranging the bonding agent in the present embodiment. The processing sequence is performed in the order shown by stages (1) to (5).

First, in stage (1), a base plate 501 in which the address electrodes 16 and the visible light reflecting layer 17 are formed on the back glass plate 15 is prepared.

Next, in stage (2), the base plate 501 is placed with the surface on which the address electrodes 16 have been formed facing downwards on a metal mold 503 with a green sheet 502 sandwiched in between. The green sheet 502 is formed only from a barrier rib paste layer, so that a green sheet which is the green sheet 202 with the resinous film and the bonding paste layer omitted is used. The metal mold 503 has the same pattern as the metal mold 403, being formed in the pattern of the barrier ribs 18, with a protrusion formed along the length of the bottom of each trough.

Next, in stage (3), the green sheet 502 is pushed down by the base plate 501 while being heated. This enables a structure in which an indentation 504 (see FIG. 23, stage (4)) is formed along the top of each barrier rib to be obtained.

In stage (4), the base plate 501 is separated from the metal mold 503, transferring the above structure to the base plate 501.

In stage (5), a bonding paste 505 is applied to the indentation 504 using a screen-printing method, the film transfer method described hereafter, or a nozzle-injection method (application may also be performed using the device used to screen print the phosphor layer, illustrated in FIG. 2). Of these methods, the nozzle-injection method can be used to apply the bonding agent Bd most accurately to the indentation 504, and so is the preferred method.

Finally, this structure is fired, forming barrier rib and bonding agent layers, the layer of bonding agent being arranged evenly across the barrier rib tops 18*a*. In addition, the bonding agent Bd is sunk into the indentations 504, so that the degree of bonding agent seepage into the cell area after the PDP is completed is less that if indentations 504 are not formed. To reduce the amount of bonding agent seepage into the cell area still further, the indentations 504 should be formed along the central part of each barrier rib 18. The reason for this is that the central part of the barrier rib 18 is the part furthest from the cells.

Note that the bonding agent coating may be performed either before or after the phosphor layer is formed between the barrier ribs.

Thirteenth Embodiment

This embodiment is characterized by a metal mold used in a method for arranging the bonding agent on the tops of the barrier ribs, as in the eleventh embodiment, so the following explanation concentrates on this metal mold.

Figure 24:
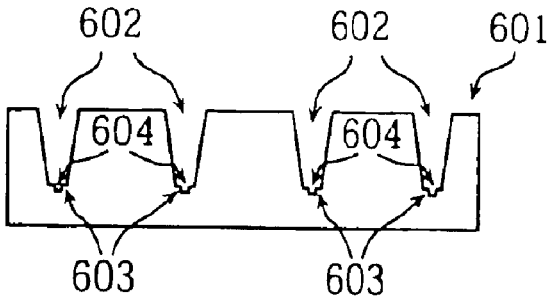
FIG. 24 is a cross-sectional drawing showing the shape of a metal mold in another embodiment.

In the present embodiment, the metal mold has a unique shape, as illustrated in FIG. 24. This metal mold 601 is shaped so that an even indentation 604 is formed along the length of the bottom part 603 of each of the troughs 602 which make up the pattern for the barrier ribs 18.

Figure 25:
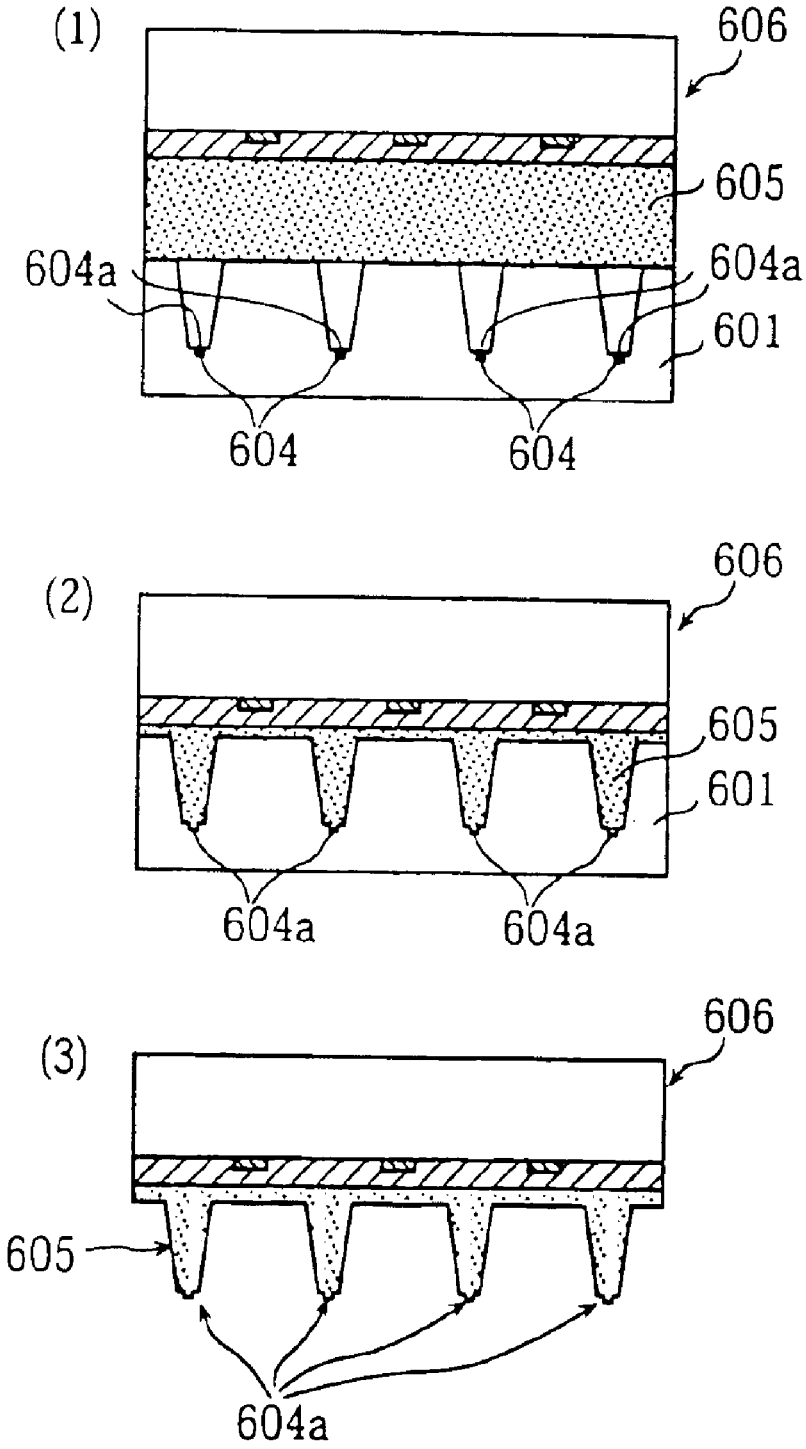
FIG. 25 illustrates a method for arranging the bonding agent on the tops of the barrier ribs using the metal mold of FIG. 24.

FIG. 25 shows the process for obtaining a structure formed from the barrier ribs and the bonding agent using the metal mold 601.

First, as shown in FIG. 25, stage (1), a base plate 606 is pushed down on a metal mold 601 sandwiching a green sheet 605 in between. A bonding paste 604*a* has already been injected into the indentations 604*a* in the metal mold 601 using the nozzle-injection method. The amount of bonding agent Bd applied is determined by the size of the indentations 604*a*. In view of the need to reduce the amount of bonding agent seepage into the cell area following the completion of the PDP, however, the indentations 604*a* should be of the smallest possible size that will achieve this while still preserving sufficient bonding strength. The indentations 604*a* should also be located along the central part of the barrier ribs 18, as was explained previously.

Following this, in stage (2), the base plate 606 is pushed down on to the metal mold 601 while being heated, so a structure formed from laminated barrier ribs 18 and bonding agent Bd can be obtained. This method determines the locations of the barrier ribs 18 and the bonding agent Bd, so that the bonding agent Bd can be arranged accurately on the barrier ribs 18.

Next, in stage (3), the base plate 606 is separated from the metal mold 601, transferring the above-mentioned structure to the base plate 606.

Finally, this structure is fired, forming barrier rib and bonding agent layers, the layer of bonding agent being arranged evenly along the barrier rib tops.

Fourteenth Embodiment

This embodiment is characterized by a method for arranging the bonding agent on the tops of the barrier ribs, so the following explanation concentrates on this method.

Figure 26:
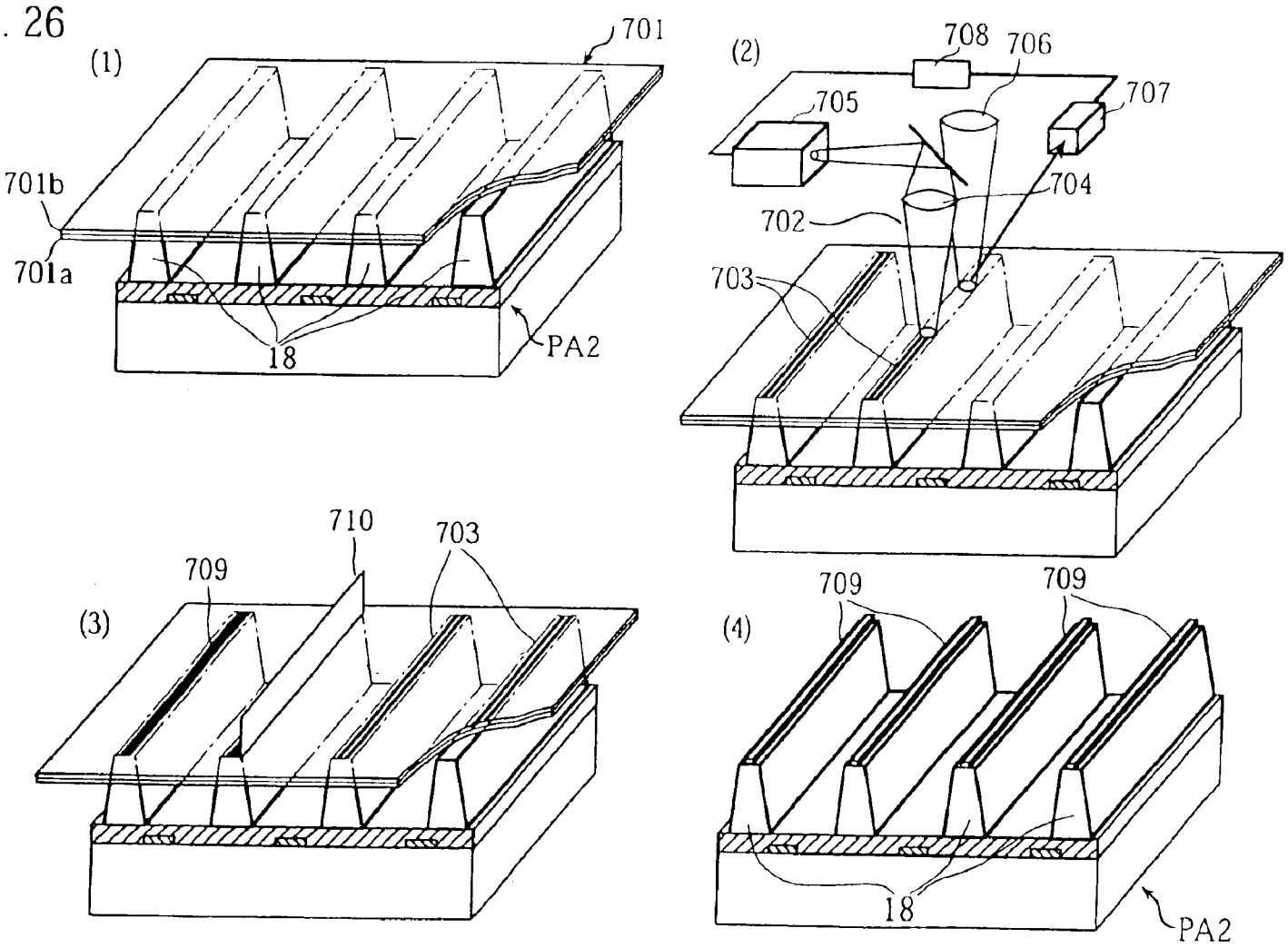
FIG. 26 illustrates a method used in another embodiment for arranging the bonding agent on the tops of the barrier ribs.

FIG. 26 is a process diagram showing a method for arranging the bonding agent in the present embodiment. The processing sequence is performed in the order of the stages (1) to (4).

First, in stage (1), a back substrate PA2, in which address electrodes 16, the visible light reflecting layer 17 and barrier ribs 18 are formed on a back glass plate 15 is prepared (a phosphor layer may be formed at this stage or later). A resinous film 701 is applied on top of the barrier ribs 18. The resinous film 701 is made from a layer of thermohardening resin 701*a* (for example epoxy resin) closest to the back substrate PA2, on which is placed a resinous film 701*b* (PET resin or similar). The resinous film 701 is pressed against the back substrate PA2 while being heated, so that the layer of thermohardening resin 701*a* hardens and is fixed to the surface of the barrier ribs 18.

Following this, in stage (2), apertures 703 are cut in the resinous film 701 at various points located along the tops

18*a* of the barrier ribs 18 by concentrating a laser beam 702 on the tops of the barrier ribs and scanning the laser beam 702 along the length of each barrier rib 18. This laser irradiation is performed by a device like the one shown in FIG. 26, stage (2). In the device shown here, a light-focusing lens 704 can be moved freely across a plane such that the optical axis is parallel to the light-receiving object (the back substrate PA2). Then, a laser beam 702 is guided from a laser beam generator 705 via optical fibers onto the light-focusing lens 704. The laser beam generator 705 emits light using yttrium aluminum garnet (YAG), and outputs the laser beam 702 in pulses. Before the laser beam 702 is scanned across the surface of the back substrate PA2, the shape of the barrier ribs is monitored using a probe light 706 and a detector 707. A control unit 708 uses the result of the monitoring to control the scan direction and strength of the laser beam 702, so that the apertures 703 can be established along the tops of the barrier ribs 18. The apertures 703 can also be established so as to correspond to the shape of the barrier ribs 18 by using this method. In this case, however, the light from the probe light 706 needs to be able to pass through the resinous film, so the resinous film 701 should have a high degree of transparency. Alternatively, the tops of the barrier ribs 18 may be coated with a black pigment which easily absorbs laser light. The laser beam 702 is absorbed by this pigment, enabling the apertures 703 to be established along the tops of the barrier ribs 18 with greater accuracy.

The amount of bonding agent applied is determined by the size of the apertures 703. In view of the need to reduce the amount of bonding agent seepage into the cell area following the completion of the PDP, however, the apertures 703 should be of the smallest possible size that will achieve this while still preserving sufficient bonding strength. The apertures 703 should also be located along the central part of each barrier rib 18 to further reduce the risk of seepage.

Next, in stage (3), a bonding agent 709 is applied to the openings 703 using a squeegee 710. Note that when the bonding agent 709 is applied, it is vital to ensure that the resinous film 701 remains in the same location relative to the back substrate PA2.

Following this, in stage (4), bonding agent 709 adhering to the surface of the resinous film 701 is removed using a tape polishing method. Then, the remaining resinous film 701 is removed using a method such as peeling off the film, melting or sublimation by a laser beam. Thus, a layer of bonding agent 709 can be formed evenly along the tops of the barrier ribs 18.

Fifteenth Embodiment

This embodiment is characterized by a method for arranging the bonding agent on the tops of the barrier ribs, so the following explanation concentrates on this method.

Figure 27:
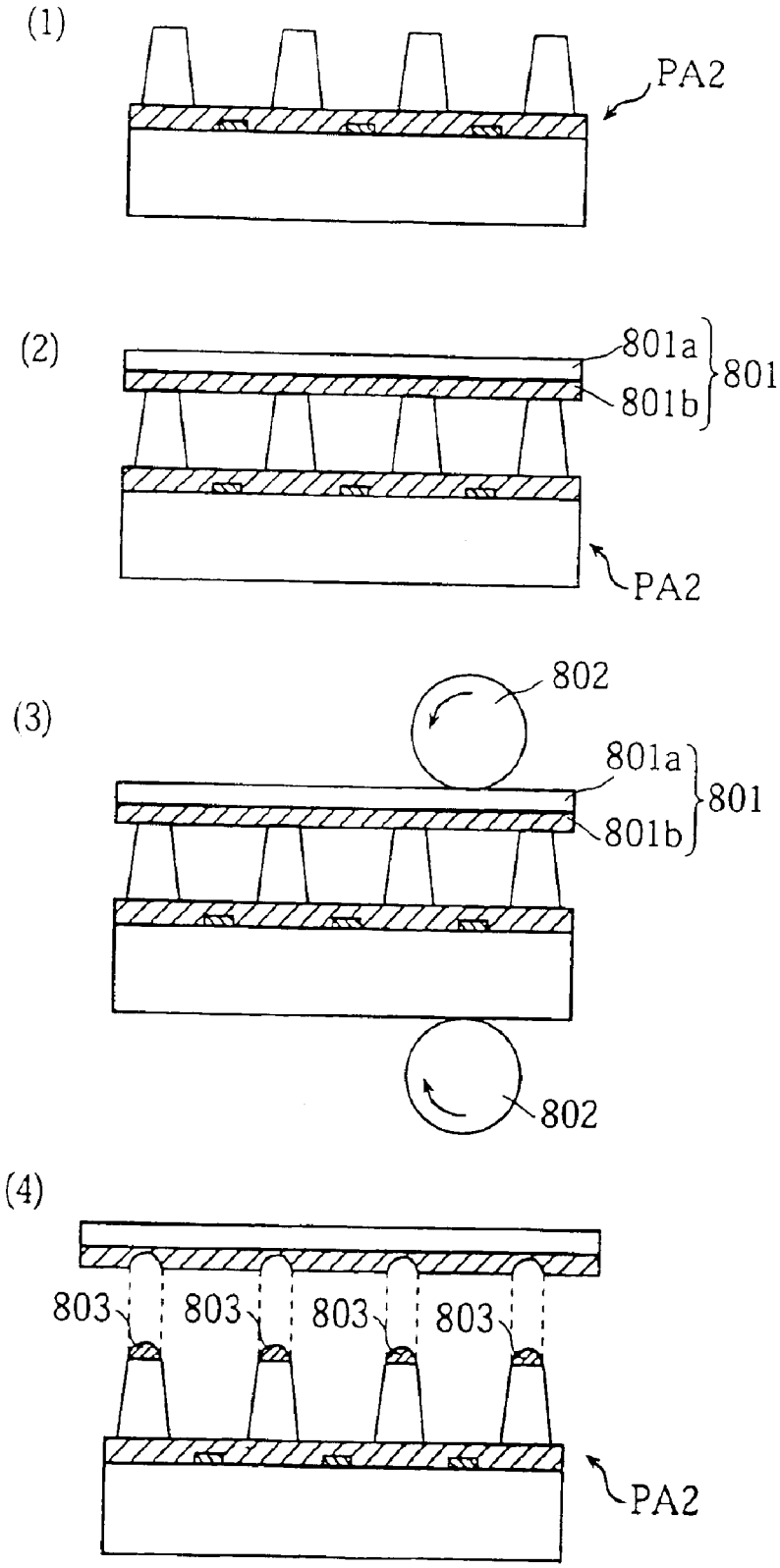
FIG. 27 illustrates a method used in another embodiment for arranging the bonding agent on the tops of the barrier ribs.

FIG. 27 is a process diagram showing the method for arranging the bonding agent in the present embodiment. The processing sequence is performed in the order of the stages (1) to (4). As shown in these drawings, the bonding agent in the present embodiment is arranged on the barrier ribs using the film transfer method described below.

First, in stage (1), a back substrate PA2, formed by arranging the visible light-reflecting layer 17 and barrier ribs 18 on a back glass plate 15, is prepared (the phosphor layer 19 may be formed at this stage or later).

Next, in stage (2), a transfer film 801 is arranged on top of the barrier ribs 18 so that the barrier ribs 18 and the transfer film 801 are touching.

The transfer film 801 is made of a layer of resinous film 801*a*, such as PET resin, to which a bonding agent layer 801*b* is applied, using a printing method such as screen-printing or a doctor blade, and then dried. The transfer film 801 is arranged on the back substrate PA2 so that the bonding agent layer 801*b* is in contact with the barrier ribs 18.

Following this, in stage (3), a pair of rollers 802 are positioned sandwiching the layered substances, and rolled across the upper surface of the resinous film 801*a* bringing an equal load to bear across the whole of the back substrate PA2. As a result of this, the bonding agent layer 801*b* is loosened from the resinous film 801*a* and attached to the tops of the barrier ribs 18.

Next, in stage (4), the transfer film 801 is peeled off from the substrate PA2 leaving the bonding agent 803 arranged evenly along the tops of the barrier ribs.

The bonding agent 803 which has not been transferred to the tops of the barrier ribs 18 needs to be removed as cleanly as possible. The preferred method for separating the transfer film 801 from the back substrate PA2 should be as shown in FIG. 28 or 29.

Figure 28:
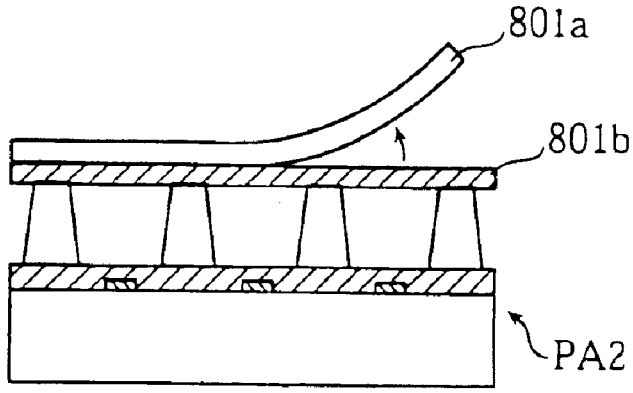
FIG. 28 illustrates a process for peeling off a transfer film, occurring in the method for applying the bonding agent shown in FIG. 27.
Figure 28:
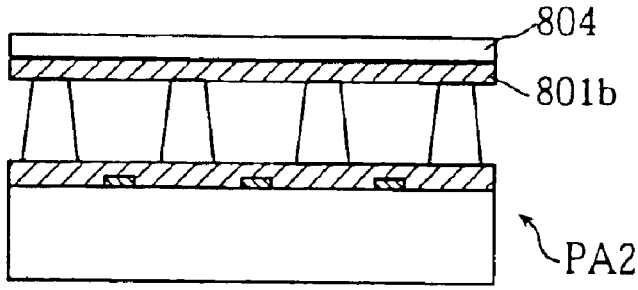
Figure 28:
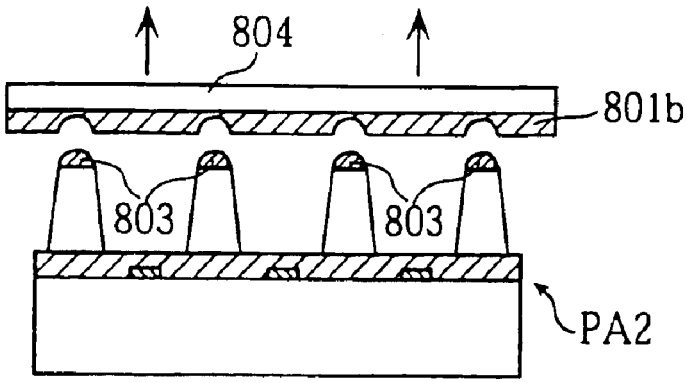

The method shown in FIG. 28 is as follows. In stage (1), only the resinous film 801*a* is peeled off. Next, in stage (2), an adhesive film 804 having an appropriate degree of adhesiveness (for example Hitalex film, produced by Hitachi Chemical Corp) is attached to the upper surface of the bonding agent layer 801*b*. Following this, in stage (3), the adhesive film 804 is lifted up, attaching the bonding agent layer 801*b* to the tops of the barrier ribs 18 while simultaneously peeling off the unnecessary parts.

Figure 29:
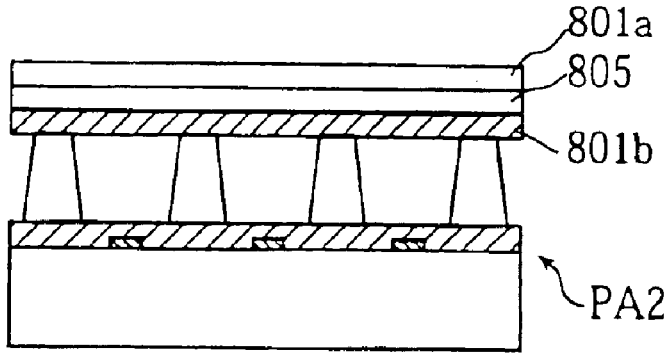
FIG. 29 illustrates a process for peeling off a transfer film, occurring in the method for applying the bonding agent shown in FIG. 27.

In the method shown in FIG. 29, a double-sided adhesive film 805 has already been placed between the resinous film 801*a* and the bonding agent layer 801*b* forming the transfer film 801. In this method, the process in which the resinous film is peeled off before the adhesive film is applied is omitted, simplifying the process for arranging the bonding agent.

Note that it is preferable if the back substrate PA2 is heated while the bonding agent 803 is transferred, since this enables the bonding agent 803 to be transferred with greater accuracy. The heating method may involve heating the surface of the roller 802 that passes across the surface of the back substrate PA2. Alternatively, the bonding agent 803 may be more accurately transferred to the tops of the barrier ribs 18 if pressure generated when the transfer film 801 is pressed onto the barrier ribs 18 is cushioned by a material placed between the transfer film 801 and the barrier ribs 18.

If a coating of a flexible substance is used as this cushioning material, the bonding agent 803 can be transferred to the tops of the barrier ribs 18 even more accurately. This is due to the previously-explained variations in the heights of the barrier ribs 18. If a coating of a non-flexible substance is used, the bonding agent 803 will not be arranged on the lower barrier rib tops 18*a*. Should a flexible coating be used, however, the bonding agent 803 can be evenly arranged on each barrier rib 18, without the variations in height having any influence.

Sixteenth Embodiment

This embodiment is characterized by a method for arranging the bonding agent on the tops of the barrier ribs, so the following explanation concentrates on this method.

Figure 30:
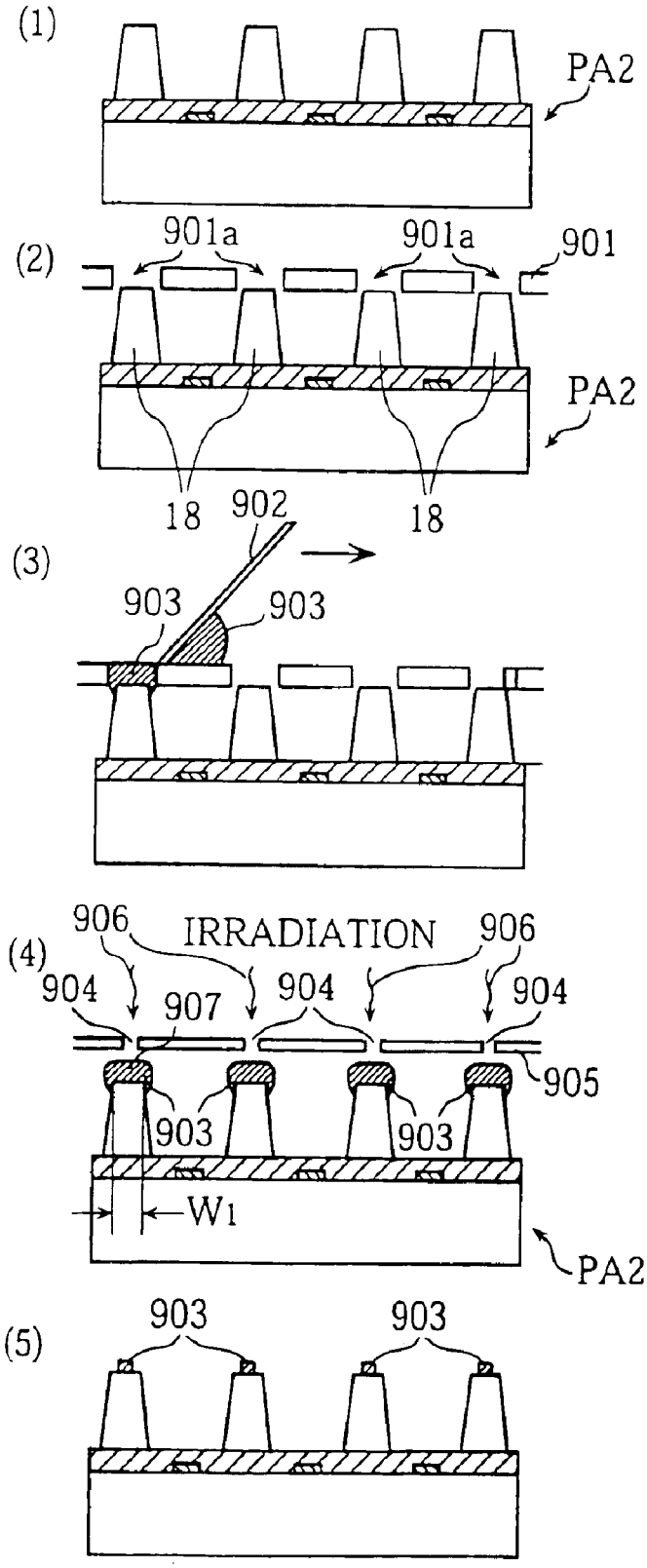
FIG. 30 illustrates a method used in another embodiment for arranging the bonding agent on the tops of the barrier ribs.

FIG. 30 is a process diagram showing the method for arranging the bonding agent in the present embodiment. The processing is performed in the order of the stages (1) to (5).

First, in stage (1), a back substrate PA2, formed by arranging the visible light reflecting layer 17 and barrier ribs 18 on the back glass plate 15, is prepared (the phosphor layer 19 may be formed at this stage or later).

Following this, in stage (2), a screen plate 901 is arranged on top of the barrier ribs 18. The screen plate 901 has apertures 901*a* placed in the same pattern as the barrier ribs 18, each aperture 901*a* being slightly wider than the top of a barrier rib 18.

Next, in stage (3), a squeegee 902 is used to spread a bonding agent 903 over the tops of the barrier ribs 18, so that the bonding agent layer 907 is slightly wider than the width of the barrier rib 18. The squeegee 902 may be made of urethane resin. The bonding agent 903 is then dried at a specified temperature of around 80° C. to 120° C. Here, the paste used for the bonding agent 903 is a composite including an acrylic resin that hardens when exposed to ultraviolet light, glass frit and various other solvents and resins.

In stage (4), a photo mask 905, in which apertures 904 have been formed in a specific pattern, is placed above the back substrate PA2. Then the bonding agent 903 located on the tops of the barrier ribs 18 is exposed to an ultraviolet light 906 with an intensity of, for example, 500 mJ/cm$^2$. The part of the bonding agent 903 exposed to the ultraviolet light 906 hardens due to the reaction of the acrylic resin that hardens when exposed to ultraviolet light, while the part of the bonding agent 903 which is not exposed to ultraviolet light remains soft. The amount of bonding agent 903 applied is determined by the size of the area exposed to ultraviolet light. In view of the need to reduce the amount of bonding agent seepage into the cell area following the completion of the PDP, however, the area exposed should preferably be narrower than the width of the tops of the barrier ribs W1 and located along the central part of the area 907 on the tops of the barrier ribs 18.

Here, heating the hardened bonding agent 903 to strengthen it still further is preferable.

Next, in stage (5), the soft areas of the bonding agent 903 are removed. This is performed by spraying with a liquid developer to develop the soft areas. The liquid developer may be at room temperature, but the developing will be performed more effectively if it is heated to a temperature of around 40° C. to 60° C. An alkaline solution such as sodium hydroxide solution or sodium carbonate solution may be used as the liquid developer.

The above process enables the bonding agent 903 to be arranged on a narrow area on the tops of the barrier ribs 18. Note that if the aperture pattern is formed in the screen plate according to the shape of the barrier ribs 18, as in stage (2), the bonding agent 903 can be applied lengthwise along the barrier ribs 18.

Seventeenth Embodiment

This embodiment is characterized by a method for applying the bonding agent to the tops of the barrier ribs before exposing it to ultraviolet light, as was shown in stage (3), so the following explanation concentrates on this method.

Figure 31:
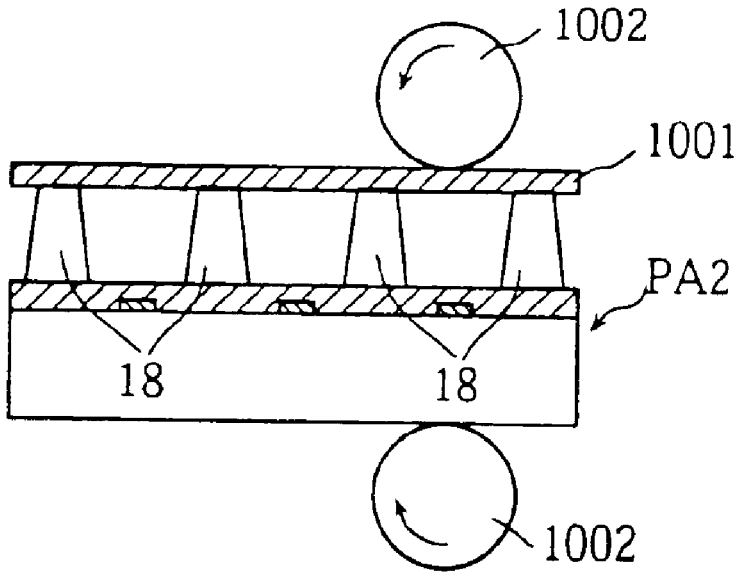
FIG. 31 illustrates a method used in another embodiment for arranging the bonding agent on the tops of the barrier ribs, which is an alternative to the method for arranging the bonding agent shown in FIG. 30.

FIG. 31 is a process diagram showing the method for arranging the bonding agent in the present embodiment. This drawing shows an identical process to that shown in FIG. 30, stage (2).

As shown in the drawing, the bonding agent is arranged on the tops of the barrier ribs by fixing a bonding agent sheet 1001, already formed from the previously described paste composite, on the barrier ribs 18. This may be performed using a pair of pressure rollers 1002. The back panel PA2 and the pressure rollers 1002 should also be heated during the fixing process in order to improve cohesiveness.

The embodiments thus far have described methods of arranging the bonding agent. At this point therefore it would seem appropriate to give a brief indication of the degree of bonding strength possessed by a PDP manufactured using the methods described in the first to seventeenth embodiments.

The inside of a PDP manufactured based on the above embodiments was pressurized by the introduction of air, and the bonding strength determined by the pressure value obtained at the time the panel exploded. The resulting value was found to be 6100 Torr ($8.11\times10^5$ Pa

Eighteenth Embodiment

This embodiment is characterized by the bonding agent itself, so the following explanation concentrates on the composition of the bonding agent.

In the present embodiment, the bonding agent applied to the tops of the barrier ribs is a mixture including beads having a higher melting point than that of the glass substance used to fix the barrier ribs and the protective layer together. Attachment is performed at a temperature between the melting points of the beads and the glass substance, so that the latter melts, but the former does not. The following effects are achieved by performing attachment at this temperature using such a bonding agent.

Figure 32A:
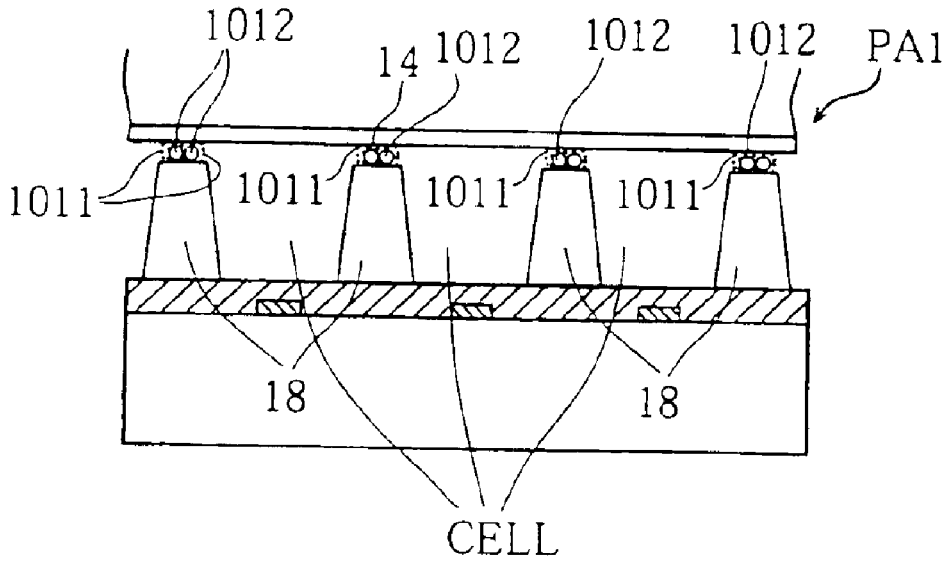
FIG. 32 shows the situation when the tops of the barrier ribs are joined to the protective layer with the bonding agent, with FIG. 32A showing the situation when a material including beads, from another embodiment is used, and FIG. 32B the situation when beads are not used.
Figure 32B:
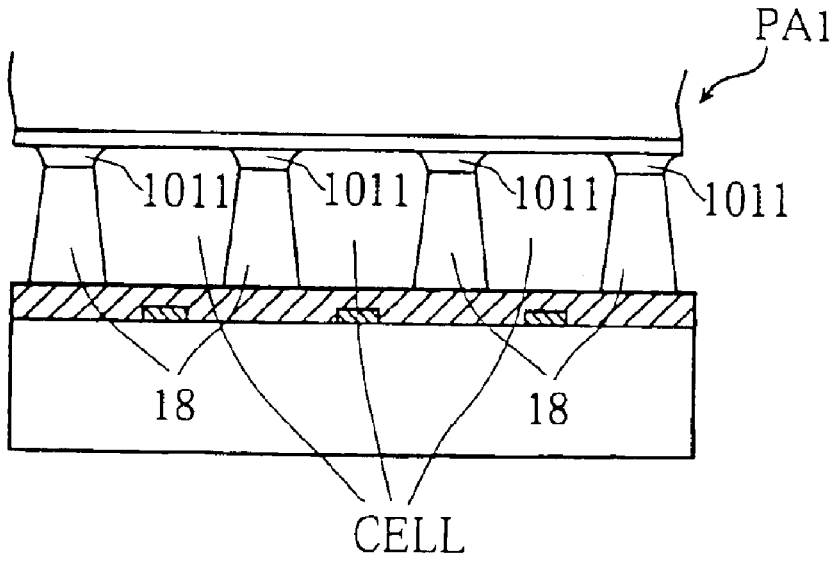

FIG. 32 shows two examples of the situation occurring when the tops of the barrier ribs 18 are attached to the protective layer using the bonding agent. FIG. 32A shows the situation when a bonding agent containing beads as described in the present embodiment is used. FIG. 32B shows the situation when a bonding agent that does not use these beads is employed.

When beads 1012 are not used, as shown in FIG. 32B, the melted glass substance 1011 is pressed downward by the weight of the front substrate PA1 during attachment. As a result, the panel is fired with the glass substance 1011 having seeped into the cell area. If beads 1012 are used, however, as shown in FIG. 30A, the weight of the front substrate PA1 is borne by the beads 1012, preventing the melted glass substance 1011 from seeping into the cell area.

The ability of the beads 1012 to prevent the melted glass substance 1011 from seeping into the cell area is greater if the particle diameter of the beads 1012 is larger, and even more marked if the particle diameter of the beads 1012 is greater than the particle diameter of the glass substance 1011. The reason for prescribing the particle diameter of the beads 1012 in this way is that the quantity of glass substance 1011 pressed down by the front panel PA1 will be reduced further.

The beads 1012 may be formed from the simple substances aluminum oxide ($Al_2O_3$) or silicon oxide ($SiO_2$), or from compounds containing these substances.

Here, the method for arranging the bonding agent may be any one of the methods described in the preceding first to seventeenth embodiments. However, if the method used is that described in any one of the first through seventh, twelfth and thirteenth embodiments the results will be more effective. This is because the method described in the first to seventh embodiments applies the bonding agent to the tops of the barrier ribs in such a way as to reduce the amount of seepage into the cell areas, and use of this in combination with the beads reduces the amount of seepage still further. The method described in the twelfth and thirteenth embodiments sinks the bonding agent into indentations in the tops of the barrier ribs, and use of this in combination with the beads also reduces the amount of seepage still further.

Nineteenth Embodiment

The PDP in this embodiment is realized by a structure in which discharge inside the panel mainly occurs in areas distanced from the section where the barrier ribs are connected to the front substrate PA1.

Figure 33:
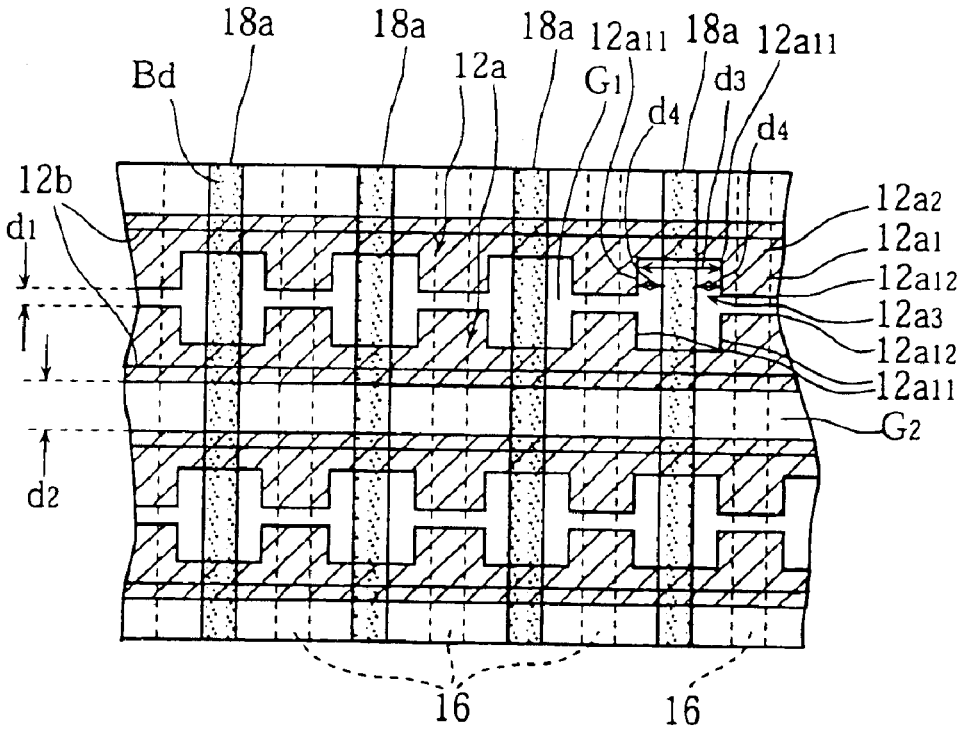
FIG. 33 shows the positional relationship between the locations of the discharge electrode pattern and the barrier ribs coated with the bonding agent.

FIG. 33 is a top view showing the positional relationship between the matrix formed by the discharge electrodes 12 and the top surfaces 18*a* of the barrier ribs coated with the bonding agent Bd.

As shown in the diagram, transparent electrodes 12*a* (shown by the diagonally-shaded areas in the drawing) are disposed in stripes with a gap G1 (a discharge gap) on one side of each transparent electrode 12*a* and a gap G1 (a dividing gap) on the other. The transparent electrodes 12*a* are formed on either side of the gaps G1, with protrusions 12*a* formed at uniform intervals of distance d3 along the main lines 12*a*2. Metal electrodes 12*b* are formed on the surface of the main lines 12*a*2 as virtually straight lines. The gaps G1 have a width of distance d1, this being the width between two facing protrusions 12*a*1. The gaps G1 have a width d2 which is wider than the width of gaps G1. Discharge occurs in the narrow gaps of the width d1 formed between the pairs of facing protrusions 12*a*1. The electrodes are separated by the wide gaps G1 of the width d2 to prevent crosstalk.

The top surfaces 18*a* of the barrier ribs 18 on which the bonding agent Bd has been applied are connected to part of the protective layer and thence to the dielectric glass layer. When the surface of the PDP is viewed from above, this part of the dielectric glass layer corresponds to the areas (indentations 12*a*3) between the protrusions 12*a*. The barrier ribs are attached to the central area of each sequence of indentations 12*a*3, so that the edges of the barrier ribs are located a distance of d4from the sides 12*a*11 of the protrusions 12*a* on either side. Here, the top surfaces 18*a* of the barrier ribs 18 are described as being located so that the discharge spaces 20 on either side are an equal distance d4 away. As long as the effects explained below can still be obtained, however, the distances on the left and right sides need not be equal. The same applies to the relative location of the top surfaces of the barrier ribs 18 to other elements explained in the following embodiments.

The following functions and effects may be obtained due to the above shape of the transparent electrodes 12*a* and the positional relationship between the top surfaces of the barrier ribs 18 coated with the bonding agent Bd and the transparent electrodes 12*a*.

First, the conditions while discharge is in progress are explained. In the initial stage of the application of a discharge sustain voltage to the transparent electrodes 12*a*, discharge starts in the gaps of width d1 between the opposing protrusions 12*a*1 belonging to different lines of electrodes. The reason for this is that a strong electric field is generated in the places where transparent electrodes 12*a* are close to one another, so that discharge is easily started. The discharge surface then spreads out towards the main lines of the transparent electrodes 12*a*.

Even if the discharge surface spreads in this fashion, however, discharge mainly occurs between the opposing protrusions 12*a*1 belonging to different lines of electrodes, rarely spreading as far as the indentations 12*a*3. This is because the electric field is weaker where the electrodes are spaced further apart.

Since discharge mainly occurs between the opposing protrusions 12*a*1 belonging to different lines of electrodes, it mainly occurs at a location separated from the bonding agent applied to the top surfaces of the barrier ribs 18 by a horizontal distance equivalent to d4.

Accordingly, the bonding agent Bd applied to the top surfaces of the barrier ribs 18 is less likely to be exposed to discharge, preventing pigments, residual carbon and the like from contaminating the discharge gas in the discharge spaces 20. As a result, increases in discharge voltage, decreases in discharge efficiency, deterioration of the phosphors and reduction in luminance are less likely, and initial operating performance can be sustained over the long term.

The following is an explanation of part of the manufacturing method for a PDP constructed as in the present embodiment. This part differs from the manufacturing methods described in the previous embodiments.

The transparent electrodes 12*a* are formed on the surface of the back glass plate 11 in a shape having the above indentations and protrusions using a photolithograph or laser application method. Then, the metal electrodes 12*b* are formed on the transparent electrodes 12*a* using a photolithograph method.

Next, the front substrate PA1 and the back substrate PA2 are fixed together by firing after the barrier ribs 18, on which the bonding agent Bd has been applied, have been correctly aligned with the surface of the protective layer 14 on the front panel PA1 and the barrier ribs 18 and the front panel PA1 pushed together.

The following is a detailed explanation of the method for forming the discharge electrodes 12.

Firstly, a formation method using lithographing techniques is explained. A transparent conductive film made of a metal oxide film, such as a layer of ITO or $SnO_2$, is formed on the front glass layer 11 using a sputter method. After this, a photoresist layer is formed on top of the metal oxide film. Lines of electrodes having the above indentations and protrusions are formed using photolithography by using a mask to expose only part of the surface to light rays.

Figure 34:
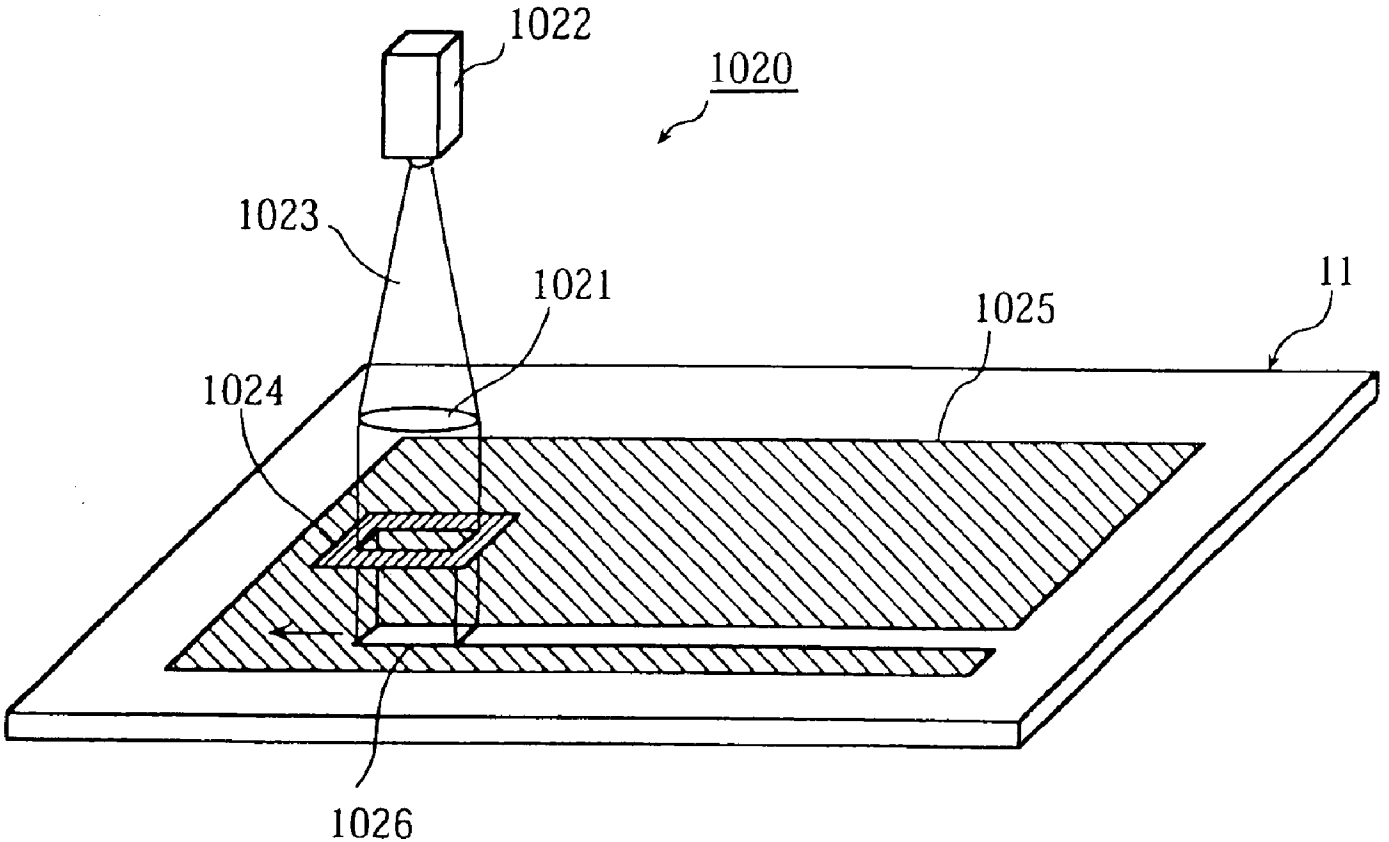
FIG. 34 is a perspective view of a laser processing device used for forming a transparent electrode pattern with a laser.

Next, a simple explanation of the laser application method is given. FIG. 34 is an outline drawing of a laser processing device 1020 for performing the laser application method.

In the device shown in FIG. 34, a light-focusing lens 1021 can be driven so that it moves freely with an optical axis on a plane parallel to the light-receiving object (the front glass plate 11). Laser light 1022 is guided from a laser generator 1022 onto the light-focusing lens 1021 via optical fibers. The laser generator 1022 emits light using YAG and outputs the laser light 1023 in pulses (the laser pulse repetition rate is, for example, 5000 PPS). The laser light 1023 is passed through an aperture 1024 to focus it on the surface of the metal oxide film 1025, forming a small spot 1026. The laser spot 1026 is, for example, a rectangle of a specific size, formed by a pulse width of 100 nanoseconds and a wavelength of 1.06 $\mu$m, with each pulse having an intensity of 1.5 $mJ/cm^2$. The size of the laser spot 1026 is determined by adjusting the dimensions of the aperture 1024 and distance of the light-focusing lens 1021 from the light-receiving body as appropriate.

The pattern for the transparent electrodes 12*a* can be formed using this laser processing device 1020 by aiming a laser at the surface of a metal oxide film 1025 (transparent conductive film) already formed on the front glass plate 11 by the sputter method, and then scanning the laser across the surface of this metal oxide film 1025 to remove parts unnecessary for the pattern.

Note that the indentations and protrusions in the transparent electrodes 12*a* may be of a semi-circular or triangular shape, instead of the rectangular shape shown here.

Twentieth Embodiment

The PDP in this embodiment is characterized by the shape of the transparent electrodes, so the following explanation concentrates on this point.

Figure 35:
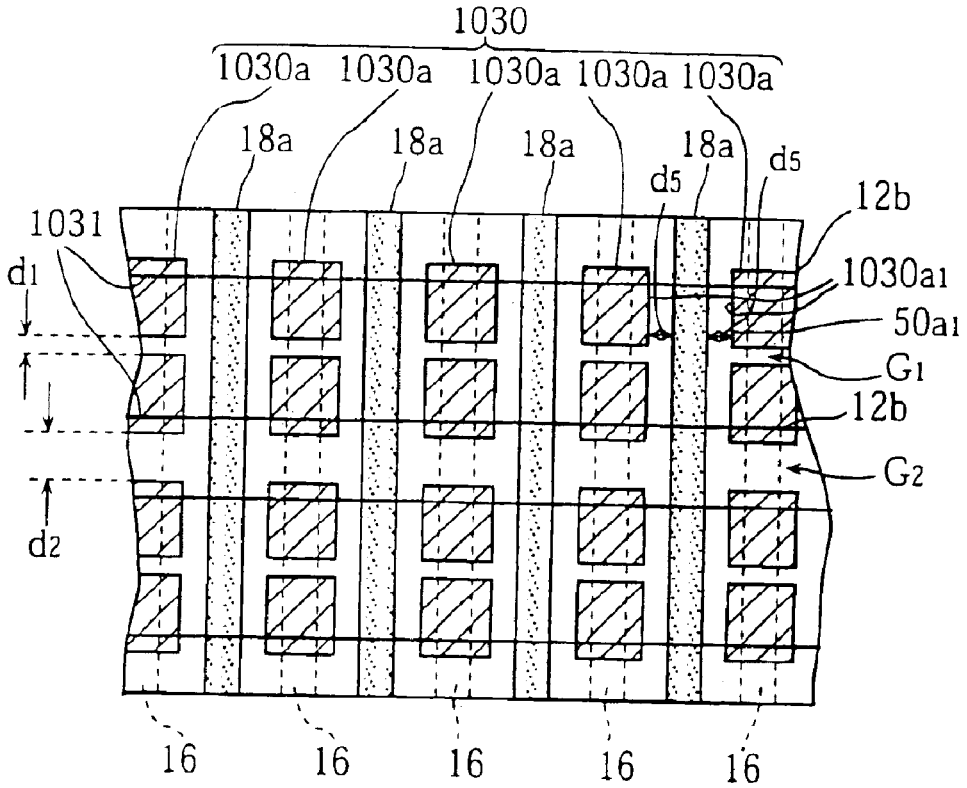
FIG. 35 shows the formation of the transparent electrodes and the positional relationship of the transparent electrodes and the barrier ribs which have been coated with the bonding agent, for a PDP in another embodiment.

FIG. 35 shows the shape of transparent electrodes 1030 and the positional relationship of these transparent electrodes 1030 and the barrier ribs 18 to which the bonding agent Bd has been applied in the present embodiment.

As shown in the drawing, the main electrodes lines 12*a*2, which linked neighboring protrusions 12*a*1 in each electrode in the nineteenth embodiment, have been removed here. Instead, transparent electrodes 1030, each of which is an isolated rectangle, are placed in a straight line a uniform distance apart. The transparent electrodes 1030 are electrically connected by metal electrodes 1031 constructed on their surface.

The top surfaces of the barrier ribs 18, to which the bonding agent Bd has been applied, are located running between pairs of adjacent transparent electrodes 1030*a* belonging to the same electrode lines. The barrier ribs 18 are attached via the protective layer to the parts of the dielectric glass layer that are separated from the transparent electrodes 1030*a* on either side by a distance d5.

By determining the formation of the transparent electrodes 1030 and the positional relationship of the transparent electrodes 1030 and the barrier ribs 18 in this way, discharge occurs mainly in the spaces between facing transparent electrodes 1030. Thus, discharge mainly occurs at positions that are a horizontal distance equivalent to d5 from the top surfaces of the barrier ribs to which bonding agent Bd has been applied.

Accordingly, the bonding agent Bd applied to the top surfaces of the barrier ribs 18 is less likely to be exposed to discharge, preventing pigments, residual carbon and the like from contaminating the discharge gas in the discharge spaces 20. As a result, increases in discharge voltage, decreases in discharge efficiency, deterioration of the phosphors and reduction in luminance are less likely, and initial operating performance can be sustained over the long term.

Twenty-First Embodiment

The PDP in the present embodiment is characterized by a pattern formed by the protective layer, so the following focuses on an explanation of this pattern.

Here, each transparent electrode is a conventional straight electrode line, without the indentations and protrusions of the nineteenth embodiment.

Figure 36:
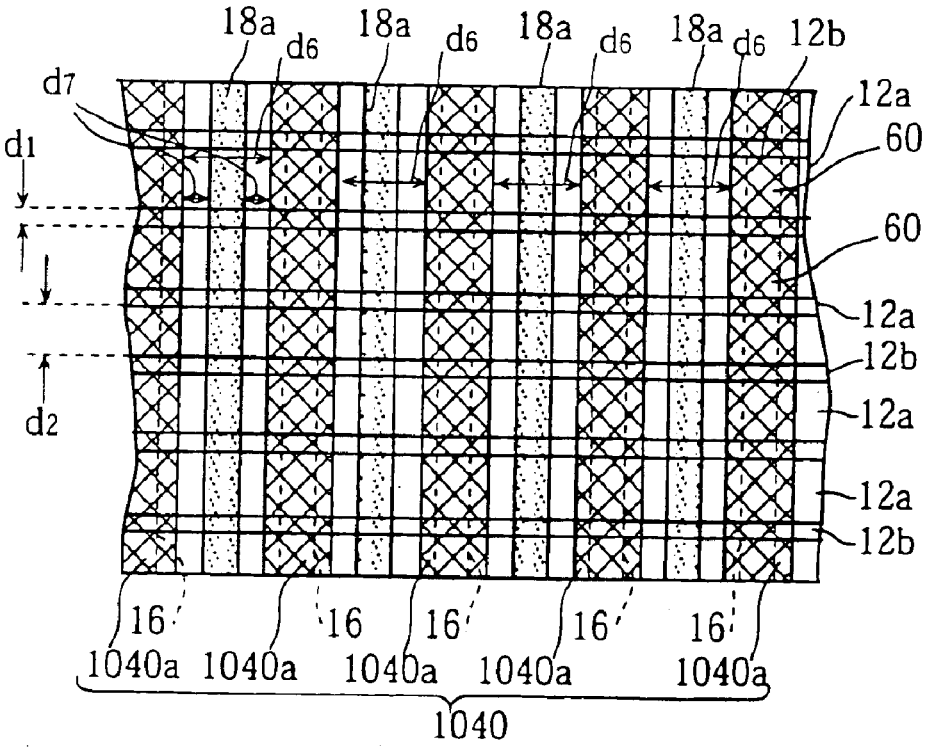
FIG. 36 shows the protective layer pattern and the positional relationship between the protective layer and the barrier ribs coated with the bonding agent, for a PDP in another embodiment.

FIG. 36 shows the pattern formed by the protective layer, and the positional relationship of the protective layer and the top surfaces of the barrier ribs on which the bonding agent Bd has been applied, in the present embodiment.

A protective layer 1040 in the present embodiment is formed on parts of the surface of a dielectric glass layer, rather than covering the whole surface of the dielectric glass layer, as was the case in the nineteenth embodiment. In other words, the protective layer 1040 in the present embodiment, as shown in FIG. 36, is formed from a plurality of long narrow strips 1040*a* placed at set intervals.

The strips 1040*a* run in the same direction as the address electrodes 16 on the back substrate PA2, and are located above the address electrodes 16, at a distance d7 from the top surfaces 18*a* of the barrier ribs 18.

By determining the formation of the pattern for the protective layer 1040 and the positional relationship of the protective layer 1040 and the barrier ribs 18 in this way, discharge mainly occurs in spaces separated horizontally from the top surfaces of the barrier ribs 18 to which bonding agent Bd has been applied by a distance equivalent to d7, as was the case in the nineteenth embodiment.

The reason for this is that secondary electrons are more likely to be released from the surface of the protective layer made of MgO than from the dielectric glass layer. A value called the secondary electron release coefficient γ (hereafter referred to as the coefficient γ) expresses the degree of ease with which secondary electrons are released as a numeric value. Since the coefficient γ for the protective layer made of MgO is higher than that for the dielectric glass layer, an MgO film is conventionally formed on the surface of the dielectric glass layer to promote the occurrence of discharge. A description of this technique may be found in issue No. 167 of the journal *Thin Solid Films*, pages 299 to 308 (pub. 1988).

Secondary electrons are mainly released from the surface of the MgO strips 1040*a*, where the coefficient γ is higher. As a result, discharge mainly occurs in the discharge spaces 20 beneath the surface of the strips 1040*a*.

Accordingly, the bonding agent Bd applied to the top surfaces of the barrier ribs 18 is less likely to be exposed to discharge, preventing pigments, residual carbon, and the like from contaminating the discharge gas in the discharge spaces 20. As a result, increases in discharge voltage, decreases in discharge efficiency, deterioration of the phosphors and reduction in luminance are less likely, and initial operating performance can be sustained over the long term.

Note that the protective layer 1040 arranged in strips as above is formed as in the nineteenth embodiment. In other words, a thin film of MgO is formed over the entire surface of the dielectric glass layer using a CVD (chemical vapor deposition) method, and a specific pattern is then formed using a method such as photolithography.

Twenty-Second Embodiment

The PDP in the present embodiment is characterized by the cross-sectional shape of the dielectric glass layer formed on the front substrate PA1, so the following explanation concentrates on this cross-sectional shape.

Here, each transparent electrode is a conventional straight electrode line, without the indentations and protrusions of the nineteenth embodiment.

Figure 37:
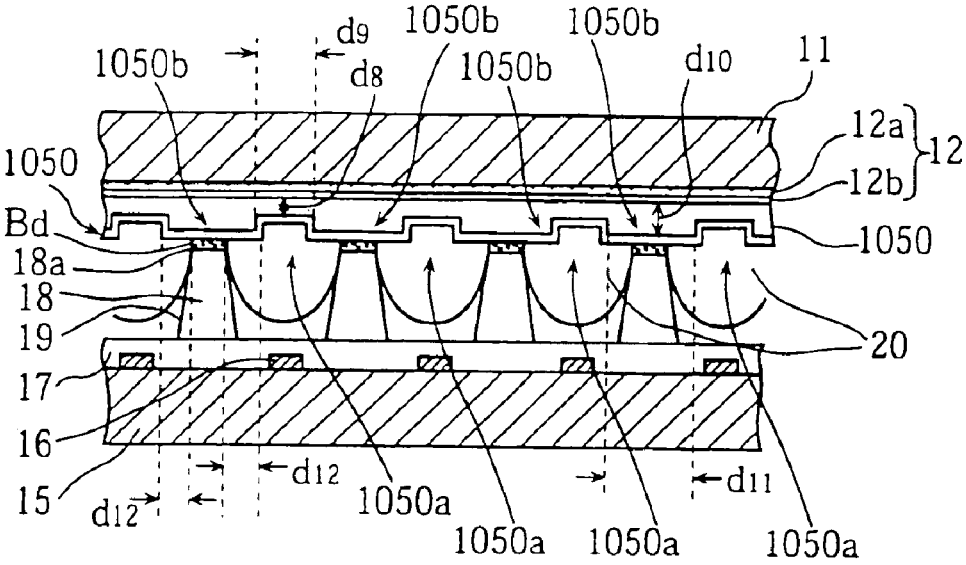
FIG. 37 shows the dielectric glass layer pattern and the positional relationship between the dielectric glass layer and the barrier ribs coated with the bonding agent, for a PDP in another embodiment.

FIG. 37 shows the cross-sectional shape of a dielectric glass layer 1050 and the positional relationship of the dielectric glass layer 1050 and the barrier ribs 18 on which the bonding agent Bd has been applied, in the present embodiment.

In the nineteenth embodiment, the dielectric glass layer formed on the front substrate PA1 was of virtually the same thickness across its entire surface. In the present embodiment, however, the thickness of the dielectric glass layer 1050 is varied at uniform intervals, as shown in FIG. 37.

This means that thin film sections 1050*a* with a thickness of d8 and a width of d9 are alternated with thick film sections 1050*b* with a thickness of d10 and a width of d11 in a stripe formation. Then the barrier ribs 18 are connected to the protective layer almost directly beneath the central part of the thick film sections 1050*b*, using the bonding agent Bd. The thin film sections 1050*a* border the top central part of each discharge space 20, at a distance of d12 from the top surfaces 18*a* of the barrier ribs 18.

By determining the cross-sectional formation of the dielectric glass layer 1050 arranged on the front substrate PA1 and the positional relationship of the dielectric glass 1050 layer and the barrier ribs 18 in this way, discharge mainly occurs in spaces separated horizontally from the top surfaces of the barrier ribs 18 to which bonding agent Bd has been applied by a distance equivalent to d12, as was also the case in the nineteenth embodiment.

In other words, the charge accumulated on the dielectric glass layer 1050 is greater where the layer is thinner. As a result, discharge occurs mainly in the parts of the discharge spaces 20 beneath the surface of the protective layer covering the thin film sections 1050*a* of the dielectric glass layer 1050.

Accordingly, the bonding agent Bd applied to the top surfaces of the barrier ribs 18 is less likely to be exposed to discharge, preventing pigments, residual carbon, and the like from contaminating the discharge gas in the discharge spaces 20. As a result, increases in discharge voltage, decreases in discharge efficiency, deterioration of the phosphors and reduction in luminance are less likely, and initial operating performance can be sustained over the long term.

The difference in thickness between the thin film sections 1050*a* and the thick film sections 1050*b* should be of around 5 to 10 $\mu$m.

The above-mentioned dielectric glass layer 1050 may be formed by using a coating method such as screen-printing, dye coating, spraying-coating or plate-coating to apply a uniform coat of a paste containing dielectric glass. Then the paste is further applied at uniform intervals in a stripe formation, and the result fired, to form a dielectric glass layer having indentations and protrusions having the variations in thickness described above.

Instead of varying the thickness of the dielectric glass layer as described above, the thickness of the protective layer attached to the surface of the dielectric glass layer may be varied using the same pattern. If differences in thickness are created in the protective layer in this way, secondary electrons will mainly be released from the thinner parts of the protective layer. As a result, discharge mainly occurs in spaces separated horizontally by a certain distance from the top surfaces of the barrier ribs to which bonding agent has been applied.

Twenty-Third Embodiment

The PDP in this embodiment is characterized by a pattern formed by the protective layer, so the following explanation concentrates on this pattern.

Here, each transparent electrode is a conventional straight electrode line, without the indentations and protrusions of the nineteenth embodiment.

Figure 38:
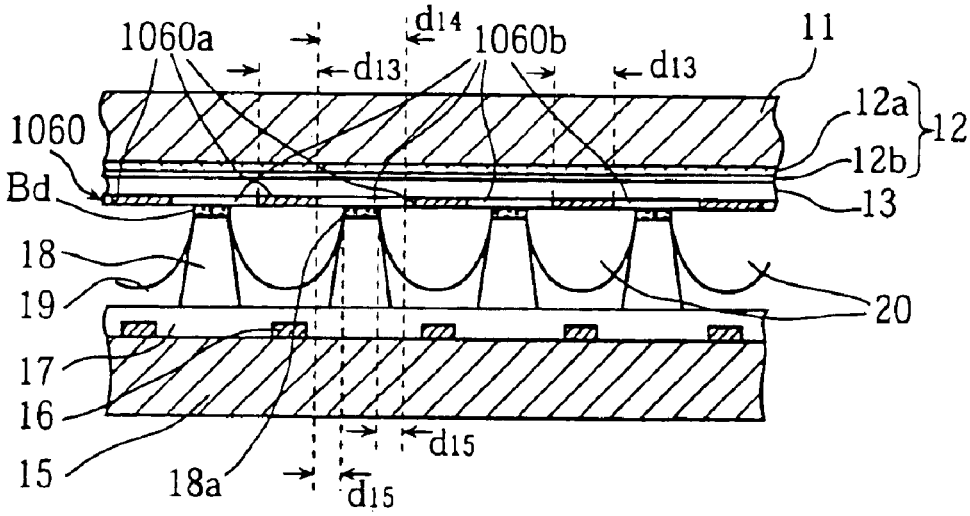
FIG. 38 shows the protective layer pattern and the positional relationship between the protective layer and the barrier ribs coated with the bonding agent, for a PDP in another embodiment.

FIG. 38 shows a pattern formed by a protective layer 1060 and the positional relationship of the protective layer 1060 and the barrier ribs to which the bonding agent Bd was applied, in the present embodiment.

In the nineteenth embodiment, the roughness of the protective layer on the front substrate PA1 was virtually identical across its entire surface. In the present embodiment, however, as shown in FIG. 38, the roughness of the protective layer 1060 is varied at uniform intervals.

This means that the surface of the protective layer 1060 bordering the discharge spaces 20 is formed from alternating stripes 1060*a* and 1060*b* having different roughnesses. The areas 1060*a* (shaded in the drawing) have a width of d13 and a roughness f1 and the areas 1060*b* have a width of d14 and a roughness f2. The surface roughness of the areas 1060*a* is greater than that of 1060*b*. The barrier ribs 18 are connected to the central surface of the areas 1060*b* using the bonding agent Bd, and the areas 1060*a* are separated by a distance of d15 from the top surfaces of the barrier ribs 18 and border on the upper central part of each discharge space 20.

By determining the surface roughness of the protective layer 1060 arranged on the front substrate PA1 and the positional relationship of the protective layer 1060 and the barrier ribs 18 in this way, discharge mainly occurs in spaces separated horizontally from the top surfaces of the barrier ribs 18 to which bonding agent Bd has been applied by a distance equivalent to d15, as was also the case in the nineteenth embodiment.

This means that secondary electrons will mainly be released from the areas 1060*a* where the surface of the protective layer 1060 is rougher. As a result, discharge mainly occurs in the areas of the discharge spaces 20 between the areas 1060*a*. The reason that secondary electrons are mainly released from the areas 1060*a* is that the rougher areas have a larger surface area available to release secondary electrons, so that the coefficient $\gamma$ is greater in those areas.

Accordingly, the bonding agent Bd applied to the top surfaces of the barrier ribs 18 is less likely to be exposed to discharge, preventing pigments, residual carbon, and the like from contaminating the discharge gas in the discharge spaces 20. As a result, increases in discharge voltage, decreases in discharge efficiency, deterioration of the phosphors and reduction in luminance are less likely, and initial operating performance can be sustained over the long term.

The difference in roughness between the areas 1060*a* and 1060*b* should preferably be of around 10 to 100 angstroms (average roughness of the center line).

The above-described protective layer 1060 may also be formed in the following way. First, an even MgO film is formed using a CVD method. Then, specified sections of the protective layer 1060 only may be etched by a method such as sputtering, performed by exposing the surface of the protective layer 1060 to plasma after it has been covered by a mask. This causes portions of the surface to become rougher.

Twenty-Fourth Embodiment

The PDP in this embodiment is characterized by the parts where the bonding agent and the front substrate connect, so the following explanation concentrates on these connecting parts.

Figure 39:
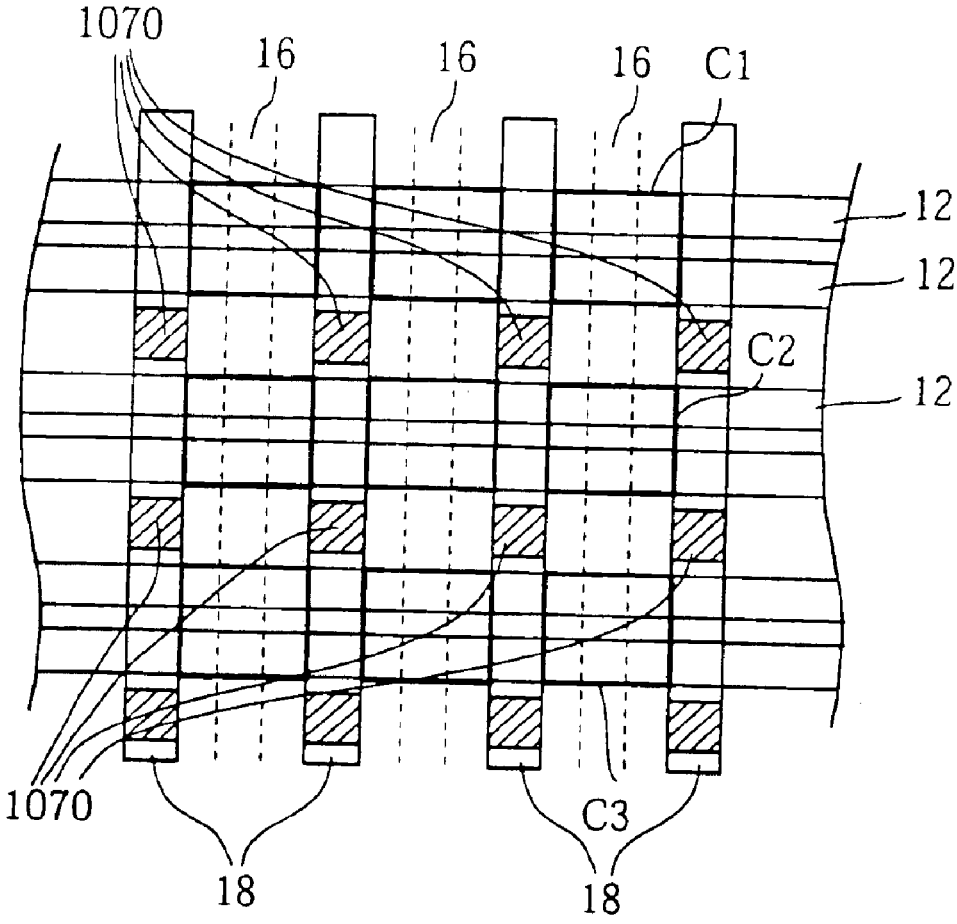
FIG. 39 shows the positional relationship between the locations of cells and the parts where the barrier ribs are connected in a PDP relating to another embodiment.

FIG. 39 is an aerial view of the structure of the PDP in the present embodiment. This drawing shows the positional relationship of the parts connected with the front substrate and the cells (the cells being the points where the discharge electrodes and the address electrodes intersect).

As shown in the drawing, the top surfaces of the barrier ribs 1070 are connected to the front substrate PA1 excluding those areas on which the cells C1, C2, C3 etc.(shown by the bold lines in the drawing) are constructed, in other words, the shaded sections 1070 in the drawing.

Accordingly, the bonding agent Bd applied to the top surfaces of the barrier ribs 18 is less likely to be exposed to discharge, preventing pigments, residual carbon and the like from contaminating the discharge gas in the discharge spaces 20. As a result, increases in discharge voltage, decreases in discharge efficiency, deterioration of the phosphors and reduction in luminance are less likely, and initial operating performance can be sustained over the long term.

This kind of connection can be simply performed by applying the bonding agent Bd to the top surfaces of the barrier ribs 18 at uniform intervals using, for example, a screen-printing method.

A panel structure that differs from those described in the nineteenth to twenty-fourth embodiments may be used, with the bonding agent arranged on the barrier rib tops so that the area covered is narrower than the width of the upper surface of each barrier rib. In this case, the bonding agent does not ooze out when connection is performed, and pigments, residual carbon and the like can be prevented from contaminating the discharge gas in the discharge spaces. Prescribing the width of the applied bonding agent in this way also increases the cell area, enabling improved luminance to be realized.

Experiment

Figure 40:
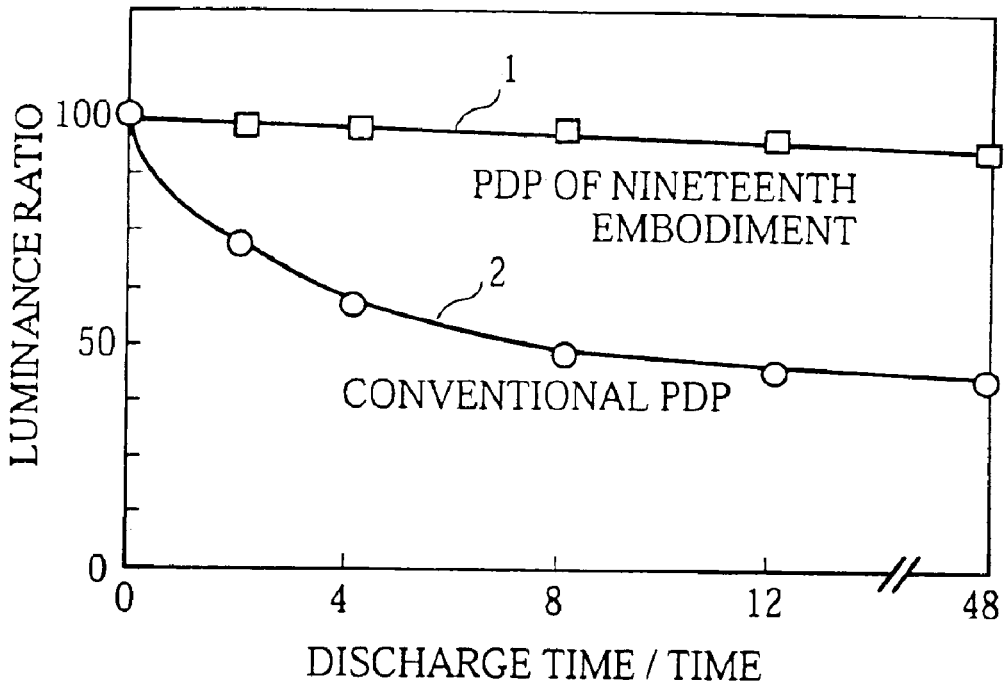
FIG. 40 shows the results of an experiment performed to investigate the effects of the nineteenth embodiment.

The changes in luminance shown when a PDP manufactured based on the nineteenth embodiment was driven continuously are shown by the median line 1 in FIG. 40. The changes in luminance shown when a PDP with conventional straight transparent electrodes was also driven continuously, as a comparative example, are shown by the median line 2 in FIG. 40.

As can be clearly seen from these results, the luminance in the comparative PDP dropped dramatically after discharge had taken place for a number of hours. In contrast, the luminance for the PDP manufactured based on the nineteenth embodiment exhibited almost no change.

The reason for this is that the PDP of the nineteenth embodiment effectively prevents changes in the properties of the bonding agent.

Note that in the first to eighteenth embodiments the front and back substrates may be connected using a conventional method such as softening the bonding agent, but connection may also be performed by softening the parts of the front and back substrates touching the bonding agent, rather than the bonding agent itself. In the former case, the bonding agent should have a lower softening point (or melting point) than the parts of the front and back substrates touching the bonding agent. In the latter case, the parts of the front and back substrates touching the bonding agent should have a lower softening point (or melting point) than the bonding agent.

The nineteenth to twenty-fourth embodiments use MgO as the protective layer, but $MgF_2$ or $MgO_x$ ($x<1$) may also be used.

In addition, in the first to eighteenth embodiments the barrier ribs were described as being placed in a stripe formation, but the barrier ribs may also be arranged in other formations.

The explanation in the first to eighteenth embodiments focused on the use of the invention in a gas display panel, but the same methods may also be used in other display panels, such as FED (field emission display) panels, provided that the panel concerned is formed from a pair of substrates, arranged in opposition and sealed together at the perimeter, on at least one of which barrier ribs are formed.

INDUSTRIAL APPLICABILITY

The display panel manufacturing method of the present invention may be used in the manufacture of display panels used for image display in televisions, computer monitors and the like.

What is claimed is:

1. A display panel manufacturing method, for connecting a pair of substrates arranged in opposition via a bonding agent arranged on a plurality of barrier ribs formed in a specific pattern on at least one of the substrates, wherein a process for arranging the bonding agent on the barrier ribs includes:

an attaching process for attaching a bonding agent positioning member to the barrier ribs;

a first removing process for removing parts of the bonding agent positioning member attached to the barrier rib tops at positions corresponding to the specific pattern, to form a groove along each barrier rib top;

a bonding agent filling process for filling the grooves with the bonding agent, while maintaining the relative positions of the grooves and the barrier rib tops;

a second removing process for removing the remaining bonding agent positioning member.

2. The display panel manufacturing method of claim 1, wherein the attaching process is performed by attaching the bonding agent positioning member to the barrier ribs after an even connecting layer is formed on either the barrier ribs or the bonding agent positioning member.

3. The display panel manufacturing method of claim 2, wherein the first removing process removes part of the bonding agent positioning member attached to the tops of the barrier ribs by irradiating the surface of the bonding agent positioning member with a laser.

4. The display panel manufacturing method of claim 1, wherein the first removing process forms holes when parts of the bonding agent positioning member attached to the tops of the barrier ribs are removed by irradiating the surface of the bonding agent positioning member with a laser.

5. The display panel manufacturing method of claim 4, wherein a material used for the barrier rib tops absorbs laser light more easily than a material used for other parts of the barrier ribs.

6. The display panel manufacturing method of claim 1, wherein the second removing process removes the remainder of the bonding agent positioning member using one of peeling, melting and sublimation.

7. The display panel manufacturing method of claim 1, wherein the bonding agent is arranged on the barrier ribs using a compound including a substance which is more difficult to melt the bonding agent.

* * * * *